US011135475B2

(12) United States Patent
Meredith et al.

(10) Patent No.: US 11,135,475 B2
(45) Date of Patent: Oct. 5, 2021

(54) GLUTE PRESS EXERCISE MACHINE

(71) Applicant: HOIST FITNESS SYSTEMS, INC., Poway, CA (US)

(72) Inventors: Jeffrey O. Meredith, Del Mar, CA (US); Bruce Hockridge, San Diego, CA (US); Billy Y. Kim, San Diego, CA (US)

(73) Assignee: HOIST FITNESS SYSTEMS, INC., Poway, CA (US)

( * ) Notice: Subject to any disclaimer, the term of this patent is extended or adjusted under 35 U.S.C. 154(b) by 119 days.

(21) Appl. No.: 16/573,400

(22) Filed: Sep. 17, 2019

(65) Prior Publication Data

US 2020/0086171 A1 Mar. 19, 2020

Related U.S. Application Data

(60) Provisional application No. 62/732,748, filed on Sep. 18, 2018, provisional application No. 62/806,506,
(Continued)

(51) Int. Cl.
*A63B 23/04* (2006.01)
*A63B 21/00* (2006.01)

(52) U.S. Cl.
CPC ..... *A63B 23/0482* (2013.01); *A63B 21/4047* (2015.10); *A63B 2208/0223* (2013.01)

(58) Field of Classification Search
CPC ..... A63B 23/0482; A63B 2208/0223; A63B 21/4047; A63B 21/4035;
(Continued)

(56) References Cited

U.S. PATENT DOCUMENTS 1,193,046 A * 8/1916 Niles ..... B41F 3/28
101/252
3,130,968 A * 4/1964 De Feen ..... A63B 23/0211
482/132

(Continued)

FOREIGN PATENT DOCUMENTS

WO 2008077117 A1 6/2008

OTHER PUBLICATIONS

Booty Builder, bootybuilder.com. https://bootybuilder.com/.

(Continued)

*Primary Examiner* — Garrett K Atkinson
(74) *Attorney, Agent, or Firm* — David R. Heckadon; Gordon Rees Scully Mansukhani LLP

(57) ABSTRACT

A glute press exercise machine including: a four-bar linkage connected to a stationary frame; a rotatable back support connected to the four-bar linkage; a seat connected to the four-bar linkage; and a foot support connected to the stationary frame. A lower portion of the back support extends below the user's hips to support the users hips during a glute press exercise. This lower portion supports at least 10% of the user's weight. In operation, the seat rotates downwardly away from the user's hips during a glute press exercise and then rotates upwardly again to contact the user's bottom between every repetition of the glute press exercise. The four-bar linkage is pivotally connected to the stationary frame at a location near ground level. The foot support is positioned below 25 cm from the ground and extends forwardly beyond the front of the stationary frame.

20 Claims, 22 Drawing Sheets

Related U.S. Application Data filed on Feb. 15, 2019, provisional application No. 62/842,175, filed on May 2, 2019.

(58) Field of Classification Search

CPC ..... A63B 2023/0411; A63B 23/0405; A63B 23/0222; A63B 21/4031; A63B 21/151; A63B 21/062; A63B 2208/0252; A63B 2208/0233; A63B 2071/0072

See application file for complete search history.

(56) References Cited

U.S. PATENT DOCUMENTS 4,535,985 A * 8/1985 Mask ..... A63B 21/0628 482/138
4,915,378 A * 4/1990 Abrahamian ..... A63B 21/4035 482/137
5,263,913 A * 11/1993 Boren ..... A63B 21/068 482/132
5,306,220 A * 4/1994 Kearney ..... A63B 23/00 482/104
5,580,340 A * 12/1996 Yu ..... A63B 21/055 482/72
5,669,865 A * 9/1997 Gordon ..... A63B 23/0222 482/142
D431,615 S * 10/2000 Webber ..... D21/675
6,152,866 A * 11/2000 Kuo ..... A63B 21/055 482/130
6,398,699 B1 * 6/2002 Yang ..... A63B 22/14 482/142
7,044,898 B2 * 5/2006 Kuo ..... A63B 21/04 482/121
7,115,081 B2 * 10/2006 Stearns ..... A63B 21/055 482/140
7,220,221 B2 * 5/2007 Mosimann ..... A63B 23/0222 482/100
7,367,928 B2 * 5/2008 Storch ..... A63B 21/00047 482/141
7,874,971 B2 * 1/2011 Reyes ..... A63B 23/085 482/133
D635,205 S * 3/2011 Thulin ..... D21/676
8,033,971 B2 * 10/2011 Campanaro ..... A63B 22/205 482/142
8,172,736 B2 * 5/2012 Contreras ..... A63B 21/00047 482/142
9,227,106 B2 * 1/2016 Richards ..... A63B 21/00192
9,526,938 B2 * 12/2016 Chen ..... A63B 21/062
9,656,118 B2 * 5/2017 Campanaro ..... A63B 21/0552
9,895,574 B2 * 2/2018 Gejdos ..... A63B 23/0211
9,901,772 B2 * 2/2018 Crowley ..... A63B 22/0023
9,919,179 B2 * 3/2018 Nevarez, Jr. ..... A63B 21/4047
9,999,800 B2 * 6/2018 Lin ..... A63B 23/03575
10,226,665 B2 * 3/2019 Kordecki ..... A63B 21/4031
10,286,256 B2 * 5/2019 Slobodnik ..... A63B 21/4035
10,420,977 B1 * 9/2019 Sullivan ..... A63B 23/03525
10,434,351 B1 * 10/2019 Addison ..... A63B 23/04
10,646,745 B2 * 5/2020 Crowley ..... A63B 22/0023
2002/0173412 A1 * 11/2002 Stearns ..... A63B 23/0405 482/123
2003/0022768 A1 * 1/2003 Lin ..... A63B 23/03525 482/123
2004/0053757 A1 * 3/2004 Chung ..... A63B 23/0482 482/140
2006/0252609 A1 * 11/2006 Abelbeck ..... A63B 21/078 482/92
2011/0028280 A1 * 2/2011 Adams ..... A63B 21/0628 482/94
2017/0056708 A1 * 3/2017 Kelly ..... A63B 21/4047
2017/0239518 A1 * 8/2017 Porteros De Luz ..... A63B 21/4029
2017/0304677 A1 * 10/2017 Clinton ..... A63B 21/068
2018/0001131 A1 * 1/2018 Nevarez, Jr. ..... A63B 21/0552
2018/0214732 A1 * 8/2018 Nevarez ..... A63B 23/0482
2019/0175984 A1 * 6/2019 Kordecki ..... A63B 21/4047
2019/0299052 A1 * 10/2019 St. Cyr ..... A63B 21/00185

OTHER PUBLICATIONS

Fitness Equipment Specialists, Hoist KL Youth Fitness Line KL-2403 Squat Press, https://fitness-equipment-specialists.com/products/hoist-kl-youth-fitness-line-kl-2403-squat-press.

Nautilus, Glute Drive Model NP-L1131, https://corehandf.com/product/nautilus-plate-loaded-glute-drive/.

International Searching Authority, International Search Report and Written Opinion for corresponding International Application No. PCT/US2019/051505, dated Dec. 4, 2019, 9 pages.

* cited by examiner

HOIST
17
216
218
216
216
218
216
218
218
200

GLUTE PRESS EXERCISE MACHINE

RELATED APPLICATIONS

The present application claims priority to U.S. Provisional Patent Application Ser. Nos. 62/732,748, entitled Hip-Thrust Exercise Machine, filed Sep. 18, 2018; and 62/806,506, entitled Hip-Thrust Exercise Machine, filed Feb. 15, 2019; and 62/842,175, entitled Glute Press Exercise Machine, filed May 2, 2019; the entire disclosures of which are incorporated herein by reference in their entireties for all purposes.

TECHNICAL FIELD

The present invention relates to a glute press exercise machine in which a reclining user pushes their lower torso forwards to lift a weight.

BACKGROUND OF THE INVENTION

Existing glute press weight lifting machines typically provide support to a reclining user and use a rotating arm attached to the frame of the device that is positioned across the user's abdomen. As the user pushes their hips/abdomen upwards, they thereby move the rotating arm which in turn pulls on a cable to lift a weight stack.

Other glute press exercises have been developed that do not rely on specialized equipment. For example, a user can simply rest their upper back or shoulders on or against a standard lifting bench, and then place a weight bar across their hips/abdomen. Next, the user proceeds to lift the weight bar by straightening their legs/back. Unfortunately, the disadvantage of this approach is that it provides very poor support to the user's back during the exercise.

What is instead desired is a simple, effective and comfortable machine for performing glute presses. Ideally, such a machine would not rely on movement of the user to rotate an exercise arm during the exercise.

Ideally as well, it would be desirable to provide a glute press exercise machine that supports a user's lower back and hips throughout the movement of the full glute press exercise.

SUMMARY OF THE INVENTION

In preferred aspects, the present system provides a glute press exercise machine, comprising: a stationary frame; a four-bar linkage connected to the stationary frame; a rotatable back support connected to the four-bar linkage; a seat connected to at least one of the bars of the four-bar linkage; a foot support connected to the stationary frame; and an abdomen restraint connected to the back support.

The rotatable back support has an upper portion and a lower portion with the lower portion extending down below the user's hips to support the users hips during the full glute press exercise. Preferably, the lower portion of the rotatable back support supports at least 10% of the user's total body weight such that the user's total body weight is not solely supported by the user's upper back and feet.

Preferably as well, the seat rotates downwardly away from the user's hips during a glute press exercise and then rotates upwardly again to contact the user's bottom between every repetition of glute press exercises.

Preferably, the four-bar linkage is pivotally connected to the stationary frame at a location near the ground level and the bars of the four-bar linkage each rotate between different non-vertical angles during a glute press exercise.

In preferred aspects, the foot support is positioned below 25 cm from the ground and the foot support extends forwardly beyond the front of the stationary frame.

Preferably, a cable connecting the rotatable back support to a weight stack assembly passes through a frame member that spans along the ground extending from a location mid-way along the stationary frame to the weight stack assembly. An optional horizontal stabilizing arm connects the weight stack assembly to a rear portion of the stationary frame.

In alternate preferred embodiments, the present system provides a hip-thrust exercise machine, comprising: a frame; a back support pivotally connected to an upper portion of the frame; a seat and foot support pivotally connected to a lower portion of the frame; and an abdomen restraint connected to the back support, wherein a user pushes the abdomen restraint upwards, tilts the back support backwards and tilts the seat and foot support forwards when the user thrusts their hips forward.

In further alternate preferred embodiments, the present system provides a hip-thrust exercise machine, comprising: a frame; a back support pivotally connected to an upper portion of the frame; a foot support pivotally connected to a lower portion of the frame; an elongated member connecting the back support to the foot support; and an abdomen restraint connected to the back support, wherein a user pushes the abdomen restraint upwards, tilts the back support backwards when the user thrusts their hips forward.

BRIEF DESCRIPTION OF THE DRAWINGS

FIG. 12 is a side elevation view of a second embodiment of the present system, prior to a user performing a hip-thrust exercise.

FIG. 22 is a side elevation view of a fourth embodiment of the present system, prior to a user performing a hip-thrust exercise.

DETAILED DESCRIPTION OF THE DRAWINGS

Figure 8:
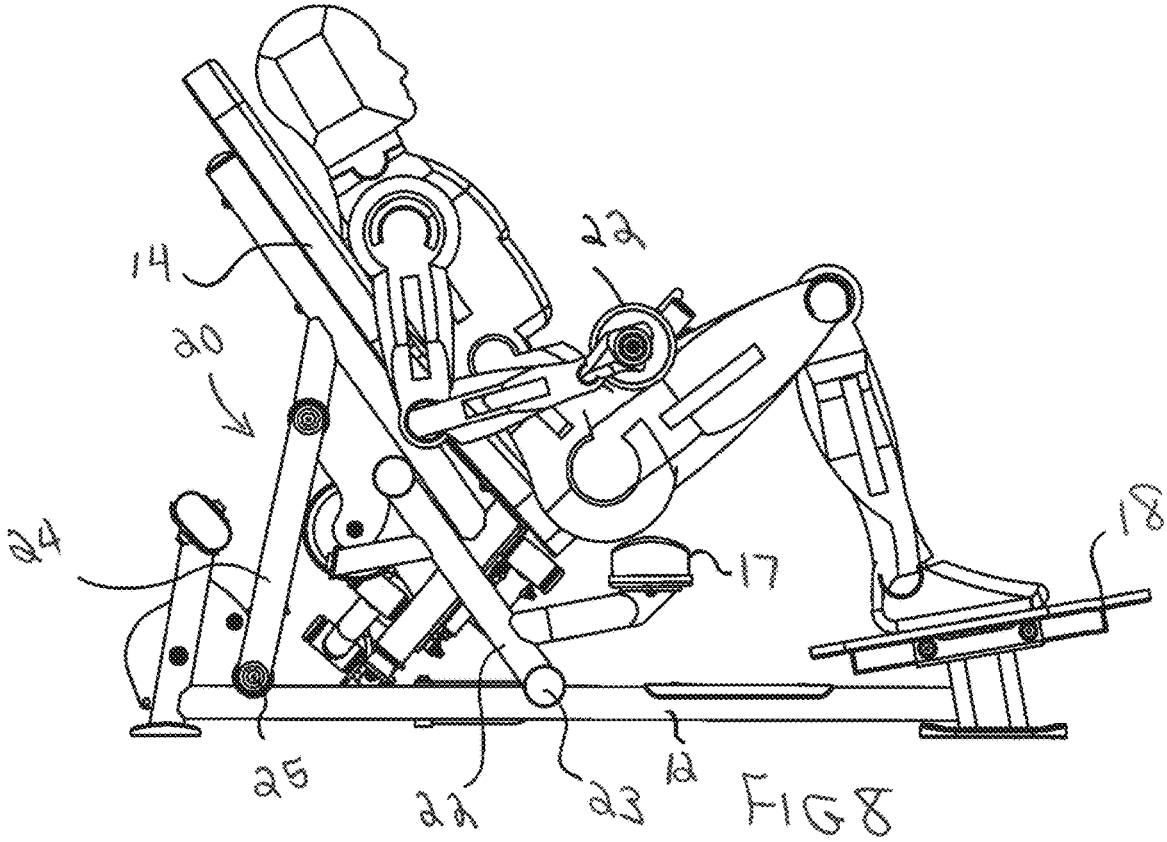
FIG. 8 is a right side elevation view of the glute press machine of FIG. 1 showing a user sitting on the seat prior to commencing a glute press exercise.
Figure 9:
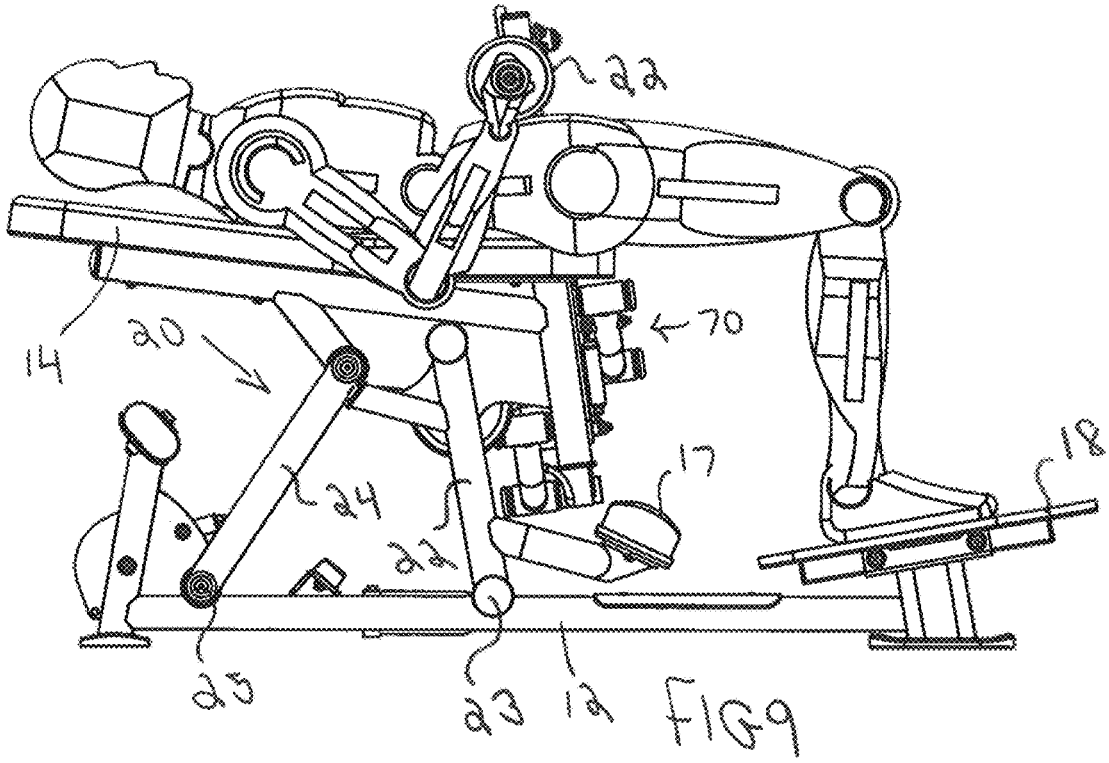
FIG. 9 is a right side elevation view of the glute press machine of FIG. 1 showing a user performing a glute press exercise.

FIGS. 1 to 11 show a first embodiment of a glute press exercise machine 10, comprising: a stationary frame 12; a four-bar linkage 20; a rotatable back support 14; a seat 17; a foot support 18 and an abdomen restraint 20. Rotatable back support 14 optionally has an upper portion 14A and a lower portion 14B. Lower portion 14B extends below the user's hips to support the users hips during a glute press exercise (as can be seen in FIG. 8). As can be seen in FIGS. 8 and 9, lower portion 14B of rotatable back support 14 preferably extends below the user's hips before, during and after each repetition of the glute press exercise.

In preferred aspects, lower portion 14B of rotatable back support 14 supports a portion of the user's weight. Most preferably, lower portion 14B supports at least 10% of the user's total body weight such that the user's total body weight is not solely supported by the user's upper back and feet. As can be seen best in FIG. 1, lower portion 14B of back support 14 can optionally be angled with respect to the upper portion. In preferred aspects, this angle is 5 to 10 degrees. In one exemplary embodiment, this angle is 7 degrees. The angling of lower portion 14B under the user's hips optionally assists in providing support under the user's hips to thereby support the user's hips. As can also be seen in FIG. 1, the upper and lower portions 14A and 14B of back support 14 are preferably formed as a continuous one-piece device.

As seen by comparing FIGS. 8 and 9, seat 17 rotates downwardly away from the user's hips during a glute press exercise and then rotates upwardly again to contact the user's bottom between each exercise repetition. As a result, seat 17 preferably contacts the user's bottom between every repetition of glute press exercises such that the user sits on seat 17 between every repetition of glute press exercises.

The four-bar linkage 20 preferably comprises four bars that are pivotally connected to the stationary frame at locations near ground level. Specifically, four-bar linkage 20 comprises two forward bars 22 and two rearward bars 24. Forward bars 22 are connected to frame 12 at pivot point 23 (right near ground level) and rearward bars 24 are connected to frame 12 at pivot point 24 (also right near ground level). As a result of back support 14 being mounted onto four-bar linkage 20 (at pivot points 23 and 25), back support 14 rotates about a horizontal axis H (see FIGS. 10 and 11) that does not pass through the stationary frame 12.

Seat 17 is preferably connected onto forward bars 22. As best seen in FIGS. 8 to 11, bars 22 and 24 each rotate between different non-vertical angles during a glute press exercise. As such, at no time during the exercise do bars 22 and 24 point straight up and down in a vertical direction. Rather, each of the four bars rotate 22 and 24 between angles of at least 40 degrees to the ground to not more than 80 degrees to the ground during a glute press exercise. Specifically, forward bars 22 rotate between an angle of about 50 to 80 degrees to the (horizontal) ground, and rearward bars 24 rotate between an angle of about 45 to 75 degrees to the (horizontal) ground.

As can also be seen, foot support 18 is also positioned close to the ground. In preferred embodiments, foot support 18 is positioned at a height of less than 25 cm from the ground. As can also be seen, foot support 18 extends forwardly beyond the front of stationary frame 12.

Abdomen restraint 20 preferably comprises a padded arm 22 that is positionable against the user's abdomen. Padded arm 22 is preferably moveable in a direction that is generally perpendicular to the back support. As such, padded arm 22 moves in a direction towards and away from the user's abdomen (i.e.: from a "far away" position to the illustrated "resting against the abdomen" position in FIGS. 8 and 9). As a result, abdomen restraint 20 and padded arm 22 prevents the user from slipping upwardly on back support 14 during a glute press exercise. As a result, abdomen restraint 20 preferably keeps the user's bottom on seat 17 at the start of the glute press exercise (FIG. 8), until seat 17 drops away from the user's bottom as the user performs the glute press (FIG. 9).

In preferred aspects, the present system further comprises: a weight stack assembly 40; and a cable connecting rotatable back support 14 to weight stack assembly 40. As the user rotates rotatable back support 14, the cable is pulled, thereby lifting one or more weights in weight stack assembly 40.

Figure 1:
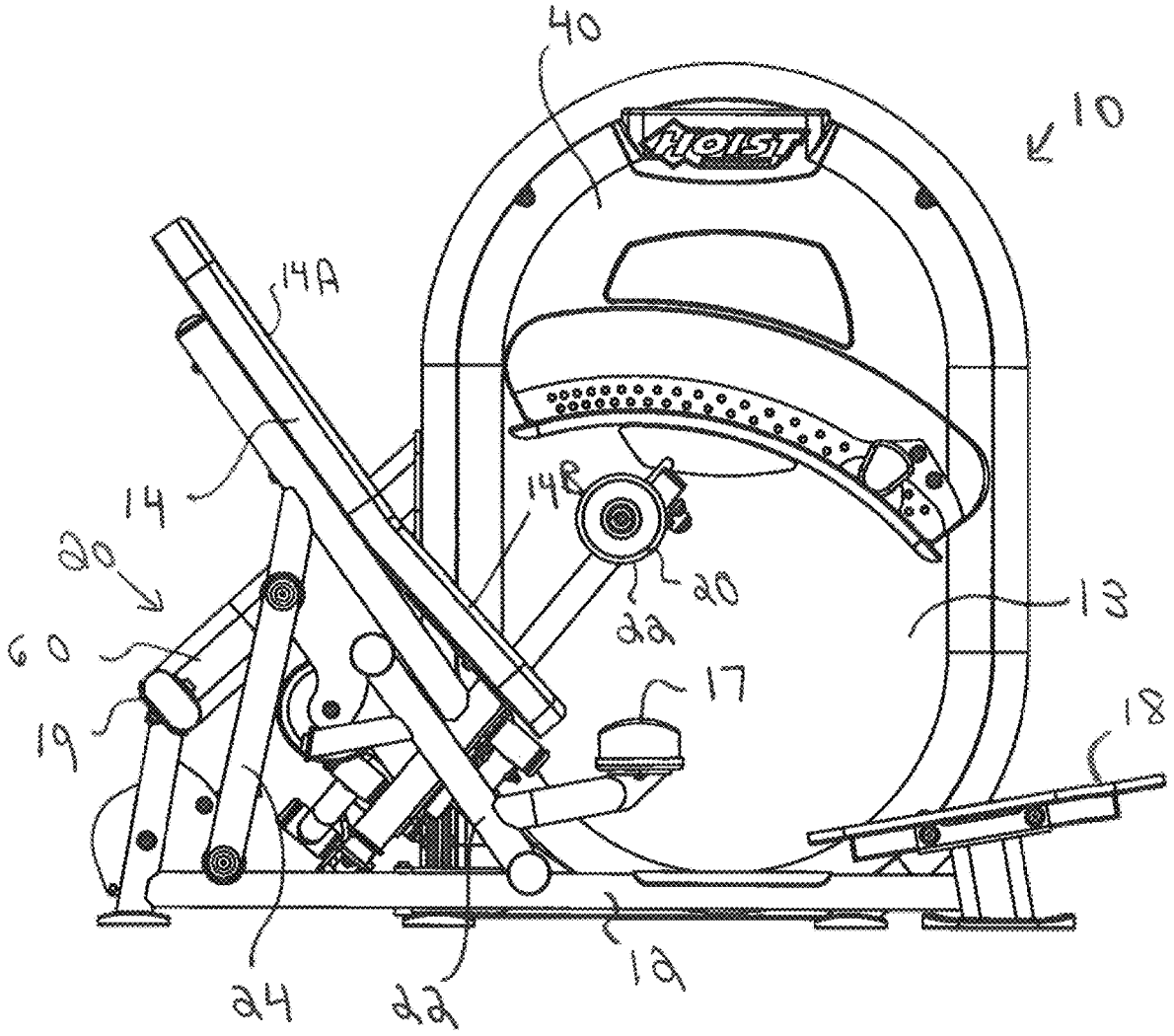
FIG. 1 is a right side elevation view of a first embodiment of the glute press exercise machine.
Figure 2:
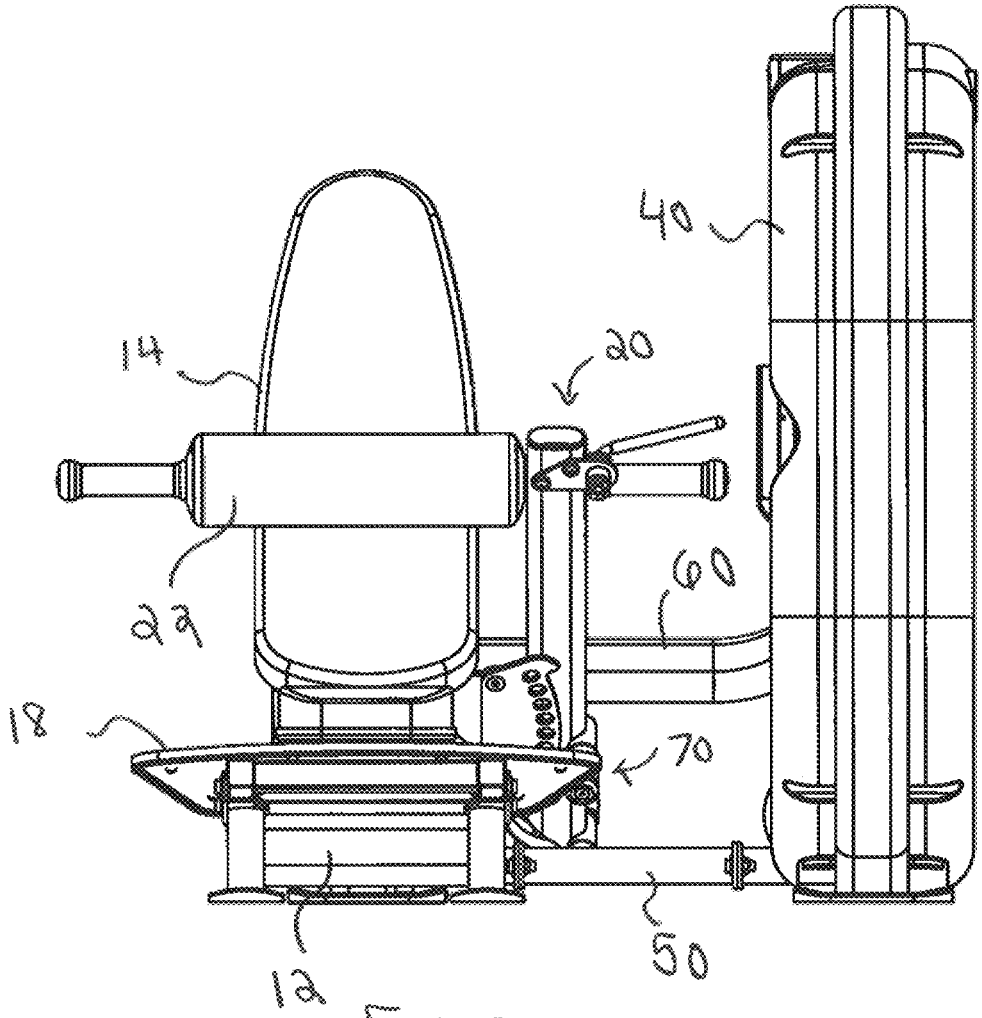
FIG. 2 is a front elevation view of the glute press exercise machine of FIG. 1.
Figure 3:
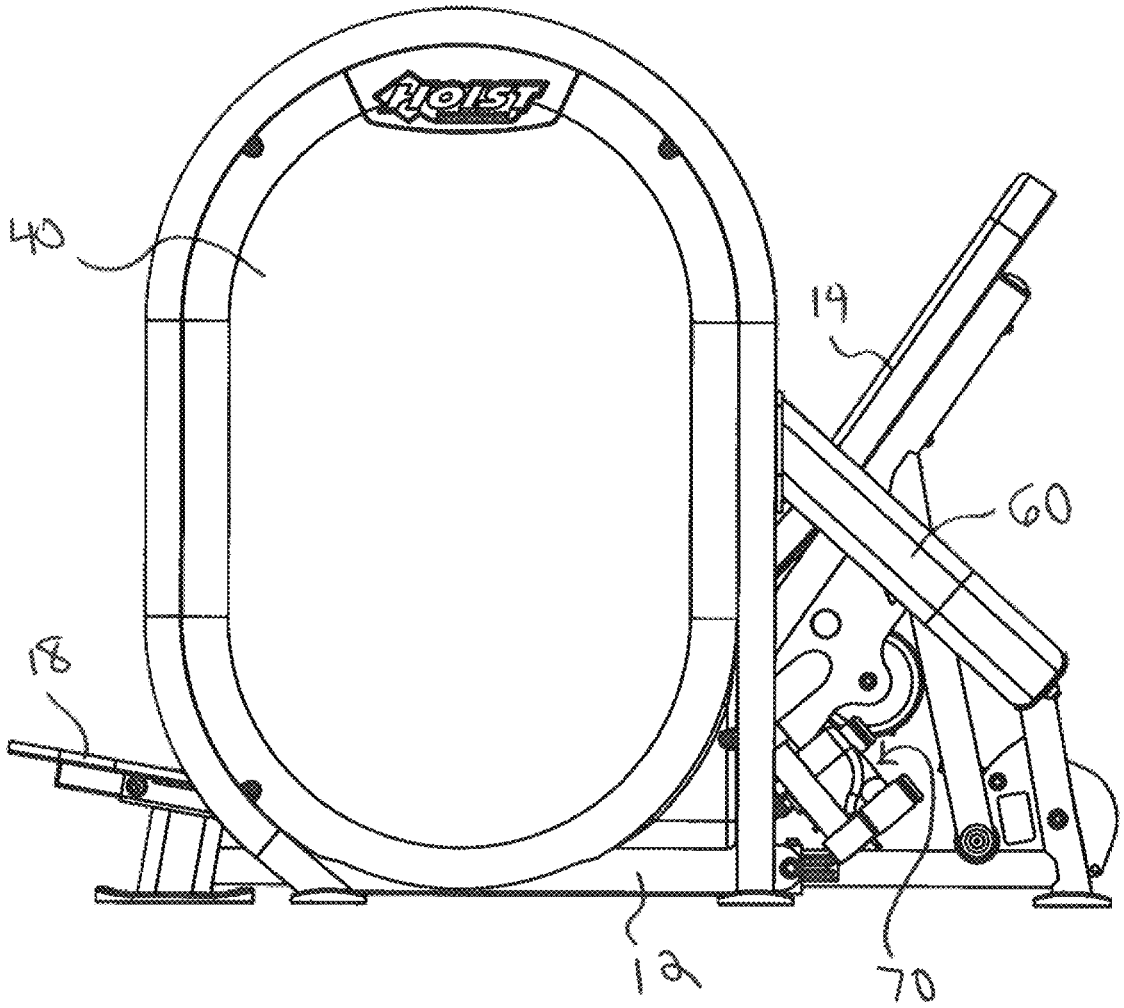
FIG. 3 is a left side elevation view of the glute press exercise machine of FIG. 1.
Figure 4:
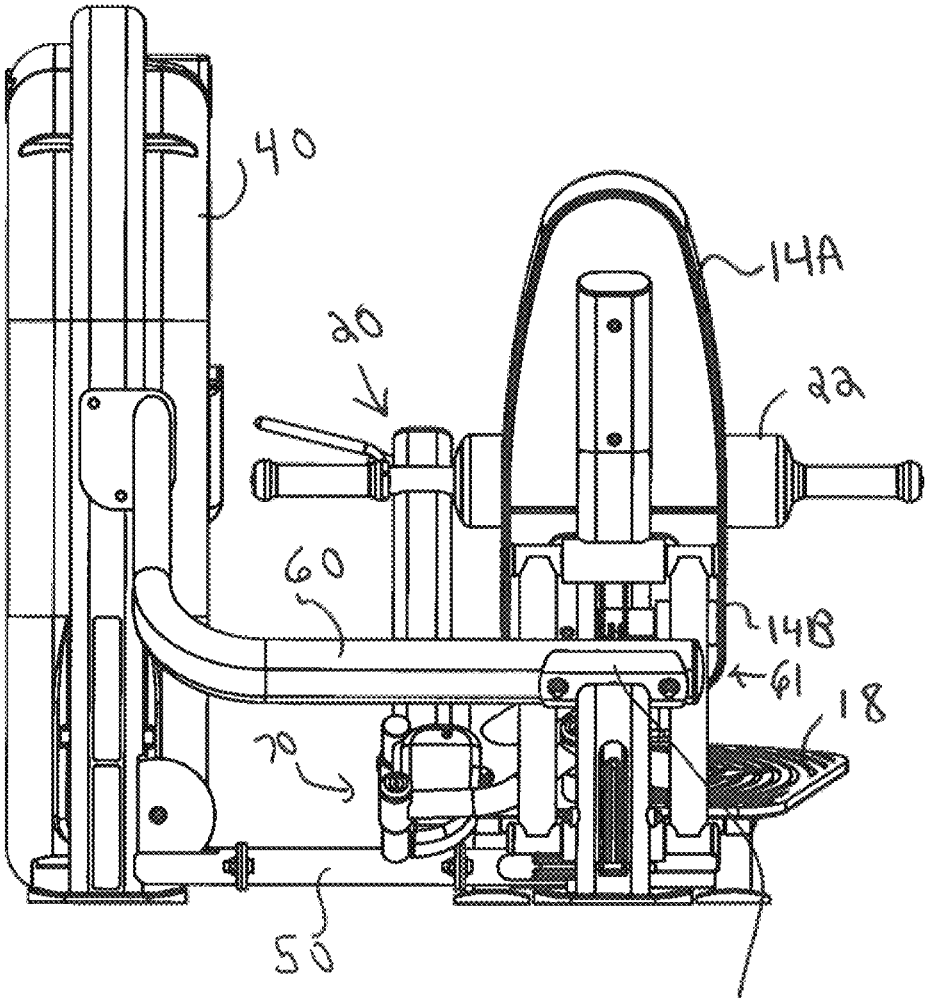
FIG. 4 is a rear elevation view of the glute press exercise machine of FIG. 1.
Figure 5:
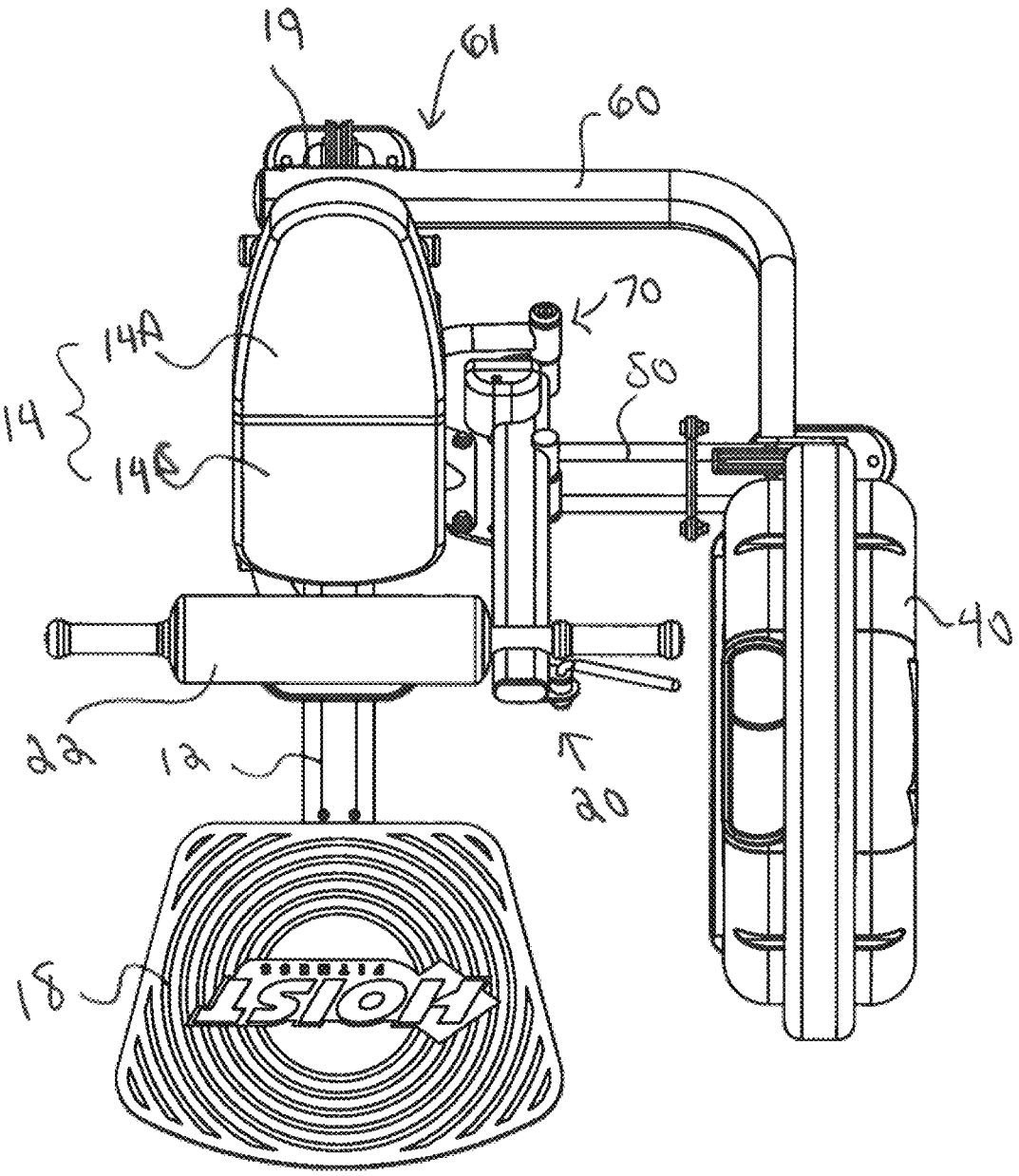
FIG. 5 is a top plan view of the glute press exercise machine of FIG. 1.
Figure 6:
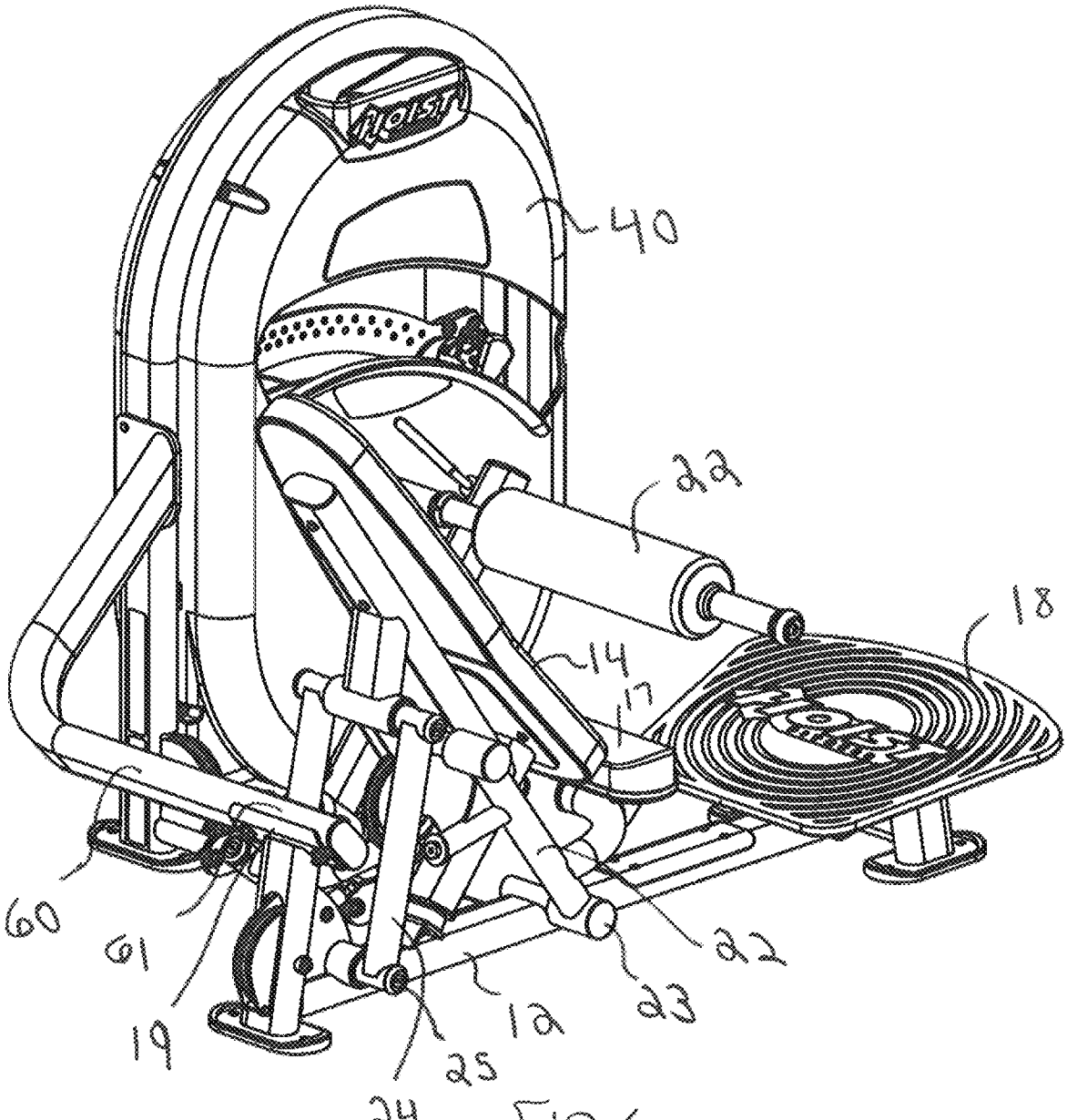
FIG. 6 is a right rear perspective view of the glute press exercise machine of FIG. 1.
Figure 7:
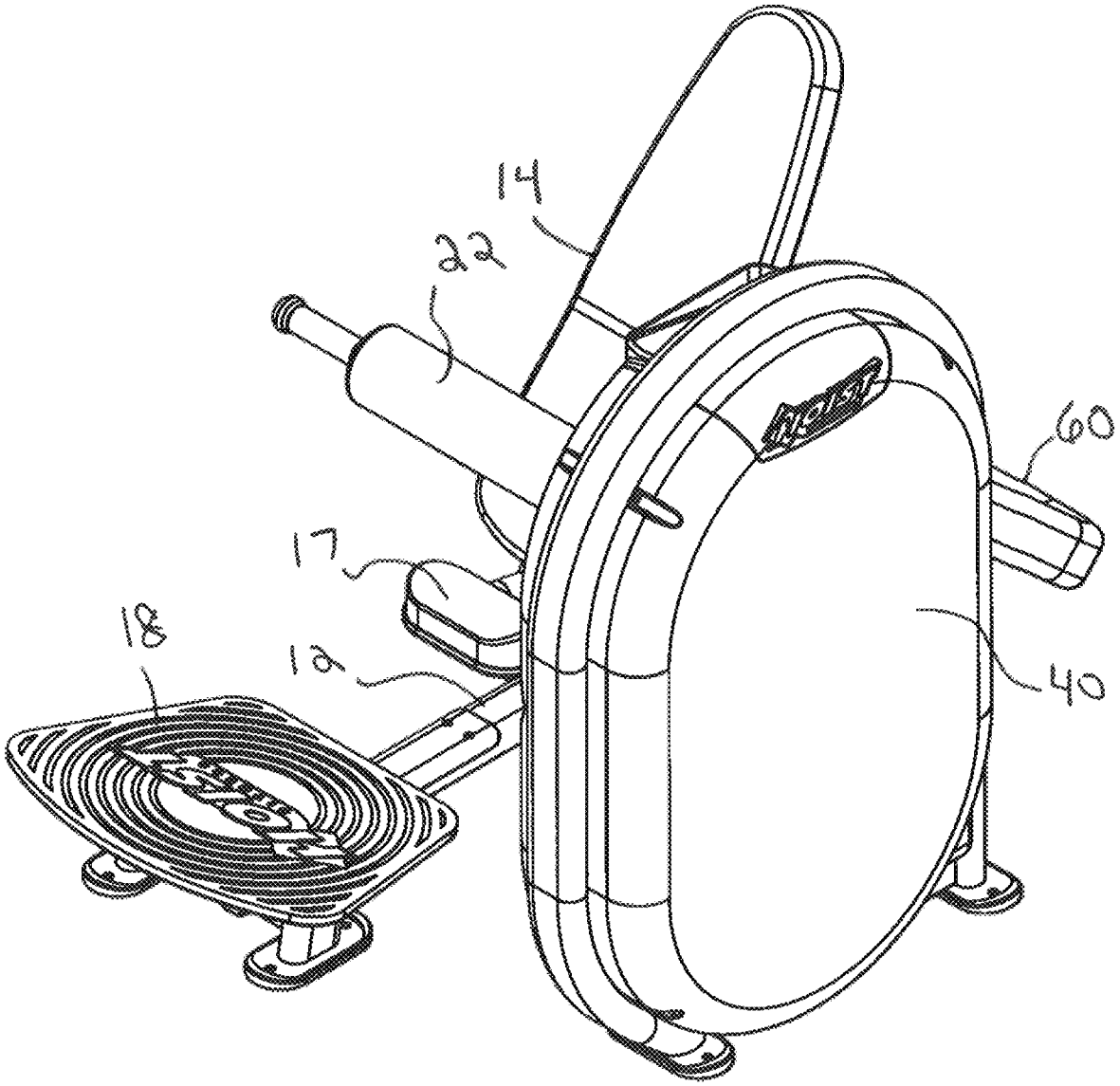
FIG. 7 is a left front perspective view of the glute press exercise machine of FIG. 1.

In preferred aspects, the cable passes through a frame member 50 that spans along the ground between the stationary frame 12 and the weight stack assembly 40. As seen in FIG. 5, frame member 50 preferably extends along the ground from a location mid-way along stationary frame 12 (i.e.: neither at the front or back of frame 12). As such, the present glute press exercise can be used to lift a stack of several weights in weight stack 13. In preferred aspects, a cable mount is provided on the bottom back of back support 14 for attachment of the cable thereto.

In addition, a stabilizing arm 60 preferably connects weight stack assembly 10 to a rear portion of stationary frame 12. As can be seen, distal end 61 of stabilizing arm 60 may simply rest upon the top of a support 19 at the rear portion of stationary frame 12. As can also be seen, stabilizing arm 60 preferably extends horizontally between weight stack assembly 40 and stationary frame 12.

In preferred aspects, abdomen restraint 20 is moveable in a direction generally perpendicular to back support 14. As such, abdomen restraint 20 preferably comprises a padded arm 22 that is moveable towards and away from the user's abdomen. In optional aspects of the present system, abdomen restraint 20 may be connected to back support 14 by a four-bar linkage 70. Other systems for moving padded arm 22 towards and away from the user's abdomen are also contemplated, all keeping within the scope of the present invention.

In operation, as shown in FIG. 8, the user sits down on seat 17 and then moves padded arm 22 into a position against their abdomen. Next, as shown in FIG. 9, the user straightens their legs, simultaneously lifting padded arm 22 while tilting back support 14 backwards as the user's hips move forward. The rearward rotation of rotatable back support 14 preferably pulls on a cable to lift one or more weights within weight stack assembly 40. Alternatively, however, the rearward rotation of rotatable back support 14 could also rotate an arm or activate a mechanical linkage that would also lift a weight, all keeping within the scope of the present invention.

Figure 10:
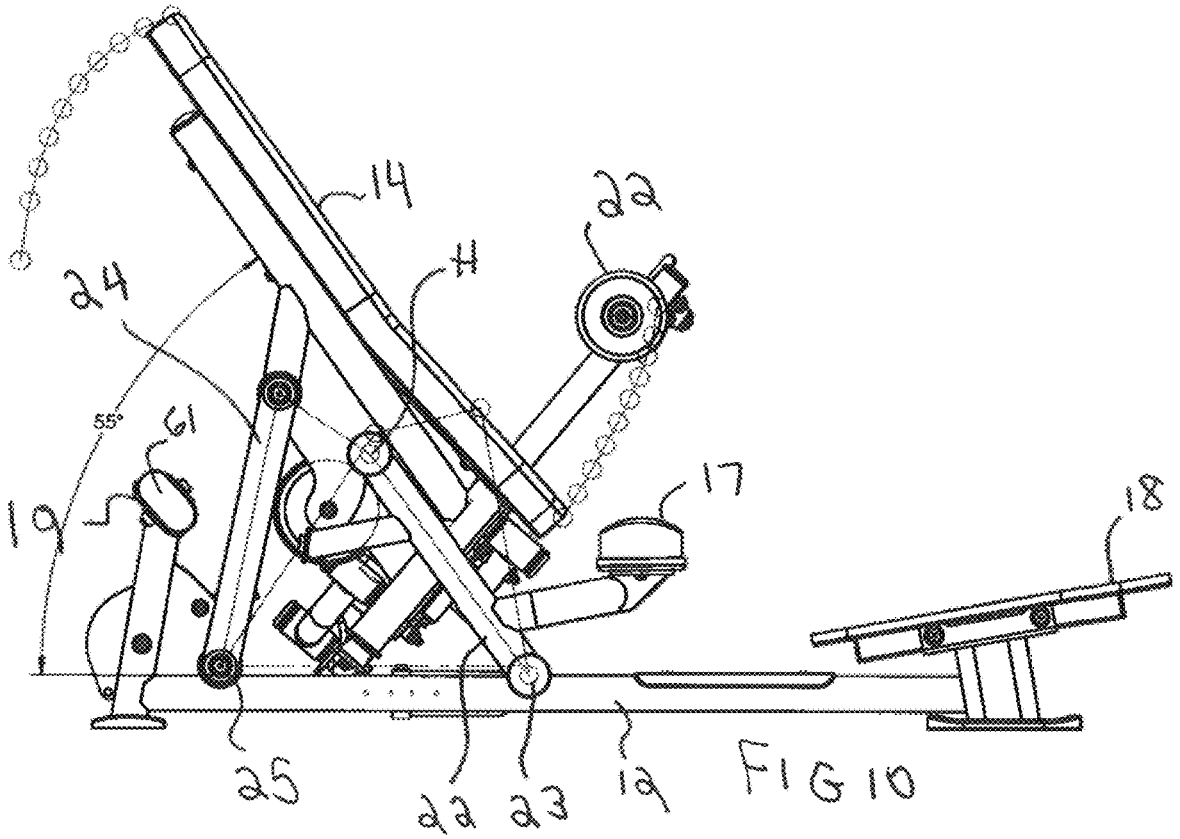
FIG. 10 is a view corresponding to FIG. 8, showing various rotational axes of the machine.
Figure 11:
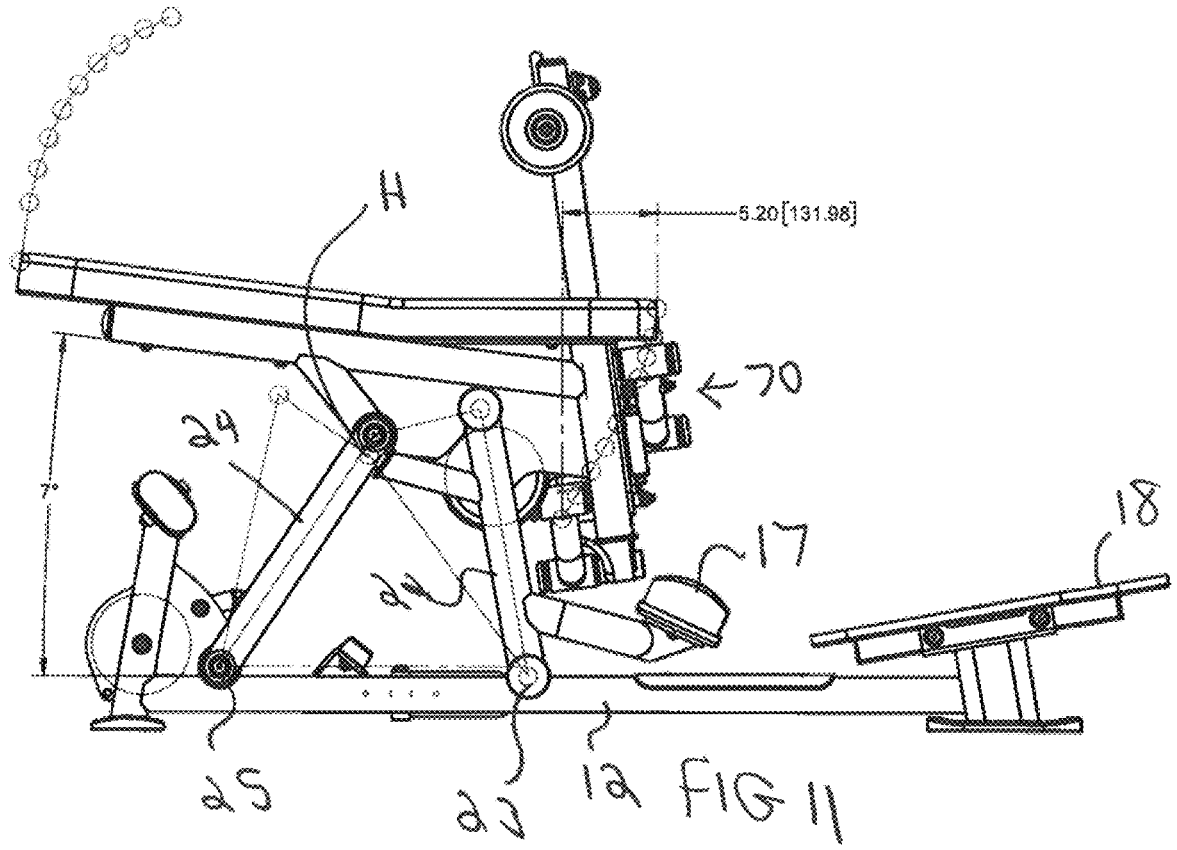
FIG. 11 is a view corresponding to FIG. 9, showing various rotational axes of the machine.
Figure 1A:
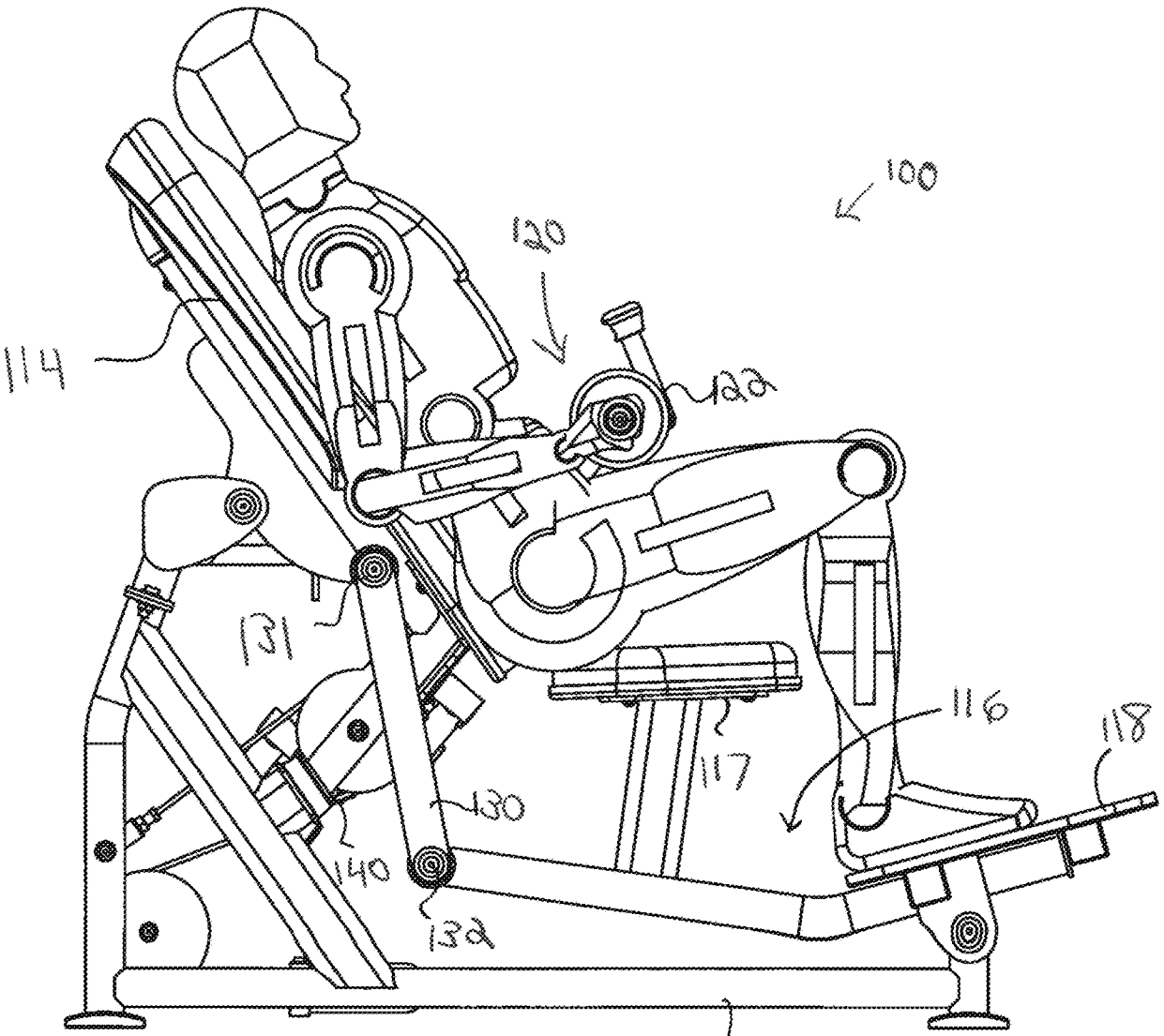

FIG. 10 is a view corresponding to FIG. 8, showing rotational movement of the system about horizontal rotational axis H (such that back support 14 rotates about axis H). FIG. 11 is a view corresponding to FIG. 9, also showing horizontal rotational axis H of the machine. As can be seen, horizontal rotational axis H does not pass through back support 14.

FIG. 12 is a side elevation view of a second embodiment of the present system, prior to a user performing a hip-thrust exercise. Specifically, FIG. 12 shows a hip-thrust exercise machine 100, comprising: a frame 112; a back support 114 pivotally connected to an upper portion of frame 112; a seat and foot support 116 pivotally connected to a lower portion of frame 112; and an abdomen restraint 120 connected to back support 114.

Abdomen restraint 120 comprises a padded arm 122 that is positionable against the user's abdomen. Specifically, padded arm 122 is in a direction generally perpendicular to the back support in a direction towards and away from the user's abdomen (i.e.: from a "far away" position to the illustrated "resting against the abdomen" position). After the user sits down on seat 117 (FIG. 12), the user then moves padded arm 122 into a position against their abdomen.

Figure 13:
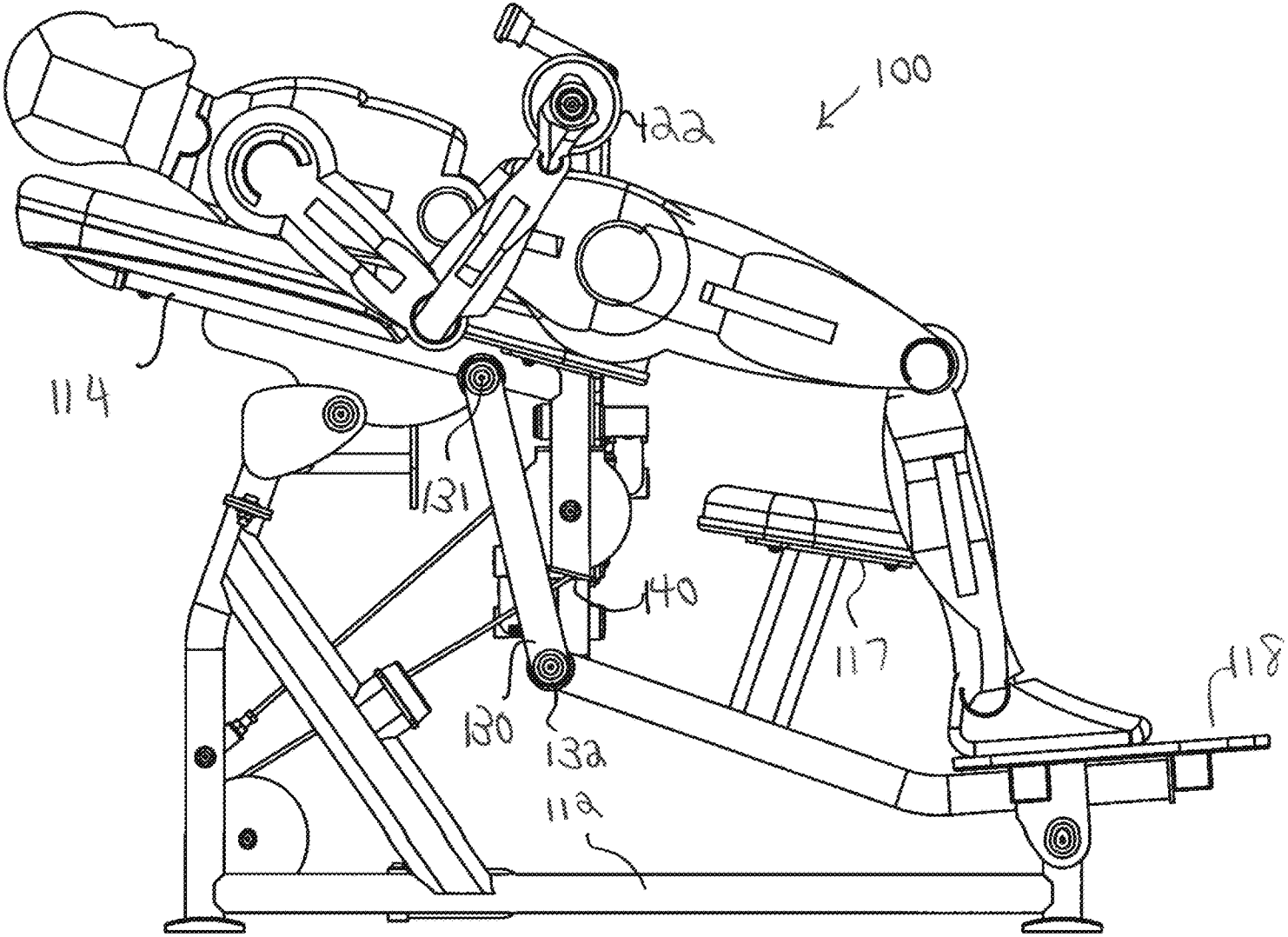
FIG. 13 is a side elevation view corresponding to FIG. 12, when the user is performing a hip-thrust exercise.
Figure 14:
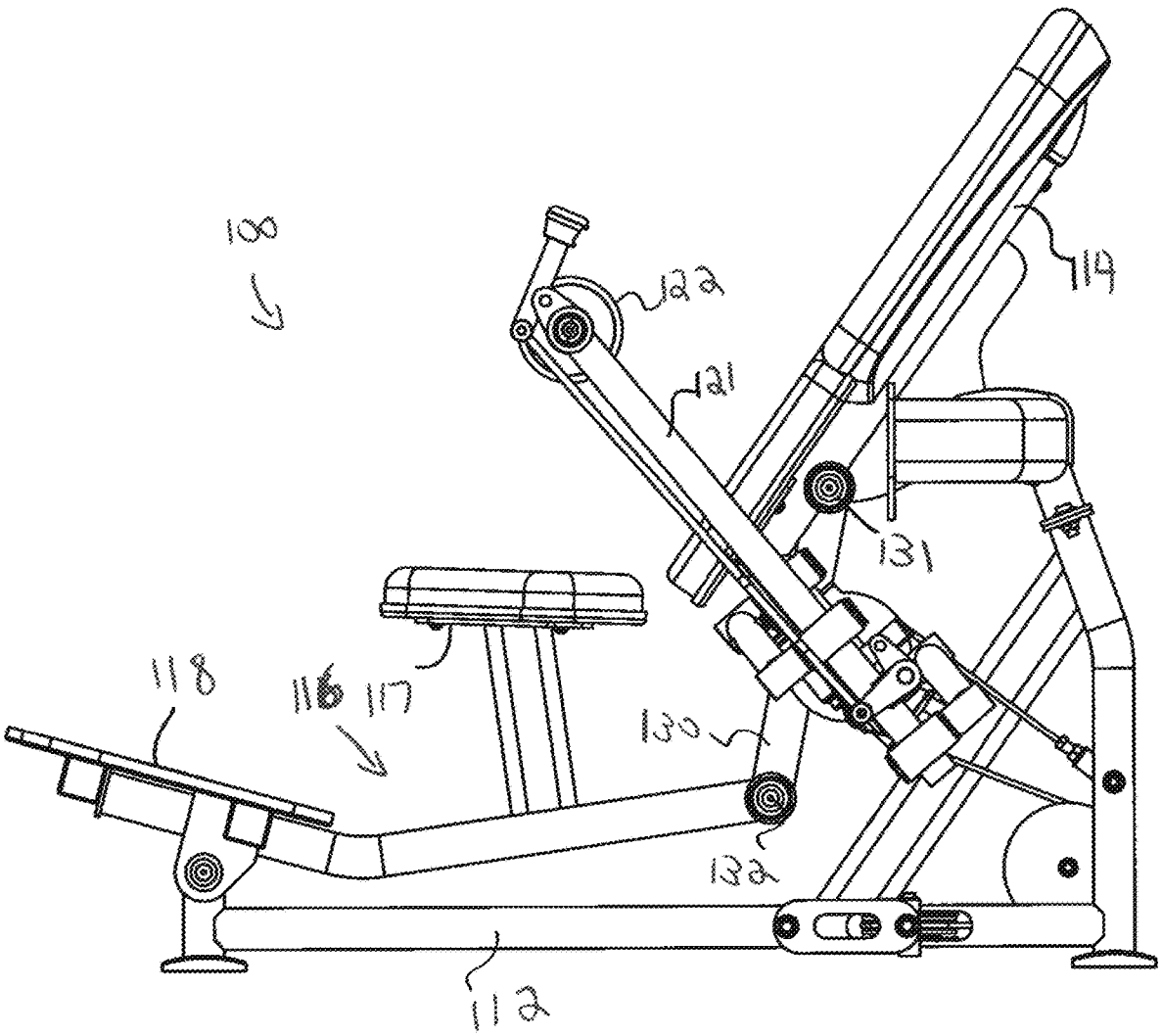
FIG. 14 is a side elevation view of the machine of FIGS. 12 and 13 with the user removed.

Next, the hip-thrust exercise is performed as shown in FIG. 13, with the user straightening their legs to simultaneously lift padded arm 122, tilt back support 114 backwards, and tilts foot pad 118 forwards as the user thrusts their hips forward. A cable mount 148 is positioned on the bottom back of back support 114 for cable attachment to a weight stack. As such, this hip-thrust exercise can be used to lift a stack of weights.

Back support 114 is connected to seat and foot support 116 by an elongated member 130, wherein a first end 131 of elongated member 130 is connected to the back support and a second end 132 of elongated member 130 is connected to the seat and foot support 116. As can be seen, the seat and foot support 116 (which comprises a seat 117 and a foot pad 118) pivots together as a single unit.

In optional preferred embodiments, abdomen restraint 120 comprises a moveable member 121. The user can adjust the position of the padded arm 122 by moving member 121 to a preferred position using positional adjuster 140.

Figure 15:
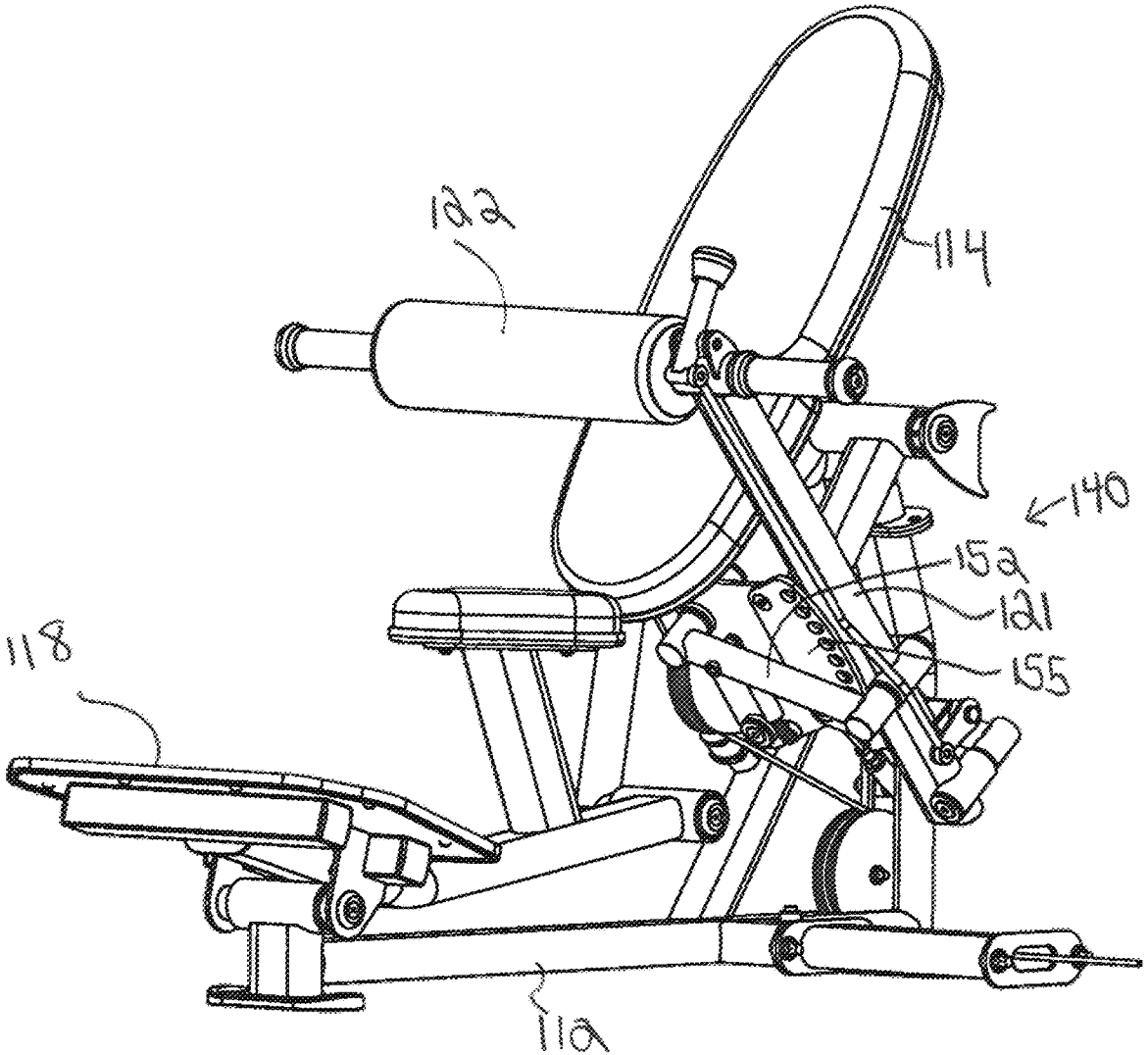
FIG. 15 is a front perspective view of the machine of FIGS. 12 and 13 showing an optional adjuster (using a 4-bar mechanism) for moving the abdomen restraint.
Figure 16B:
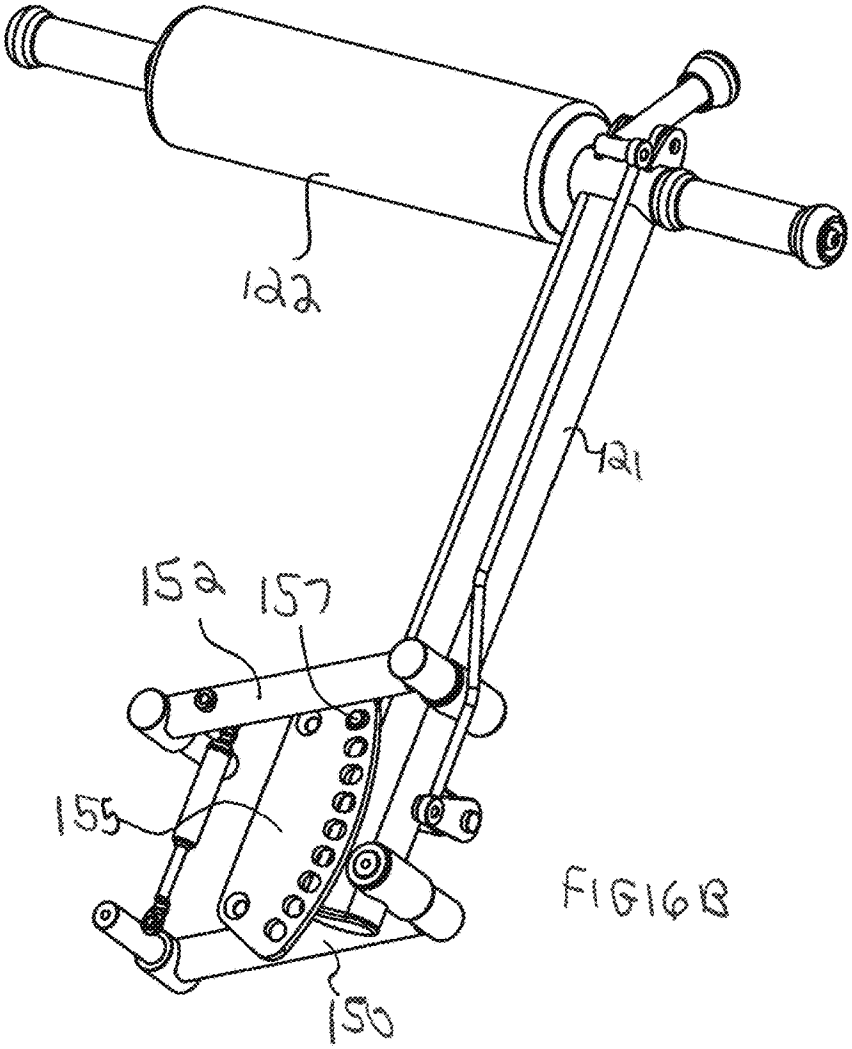
FIGS. 16A and 16B are left and right perspective views similar to FIG. 15, but showing only the 4-bar adjuster mechanism.
Figure 16A:
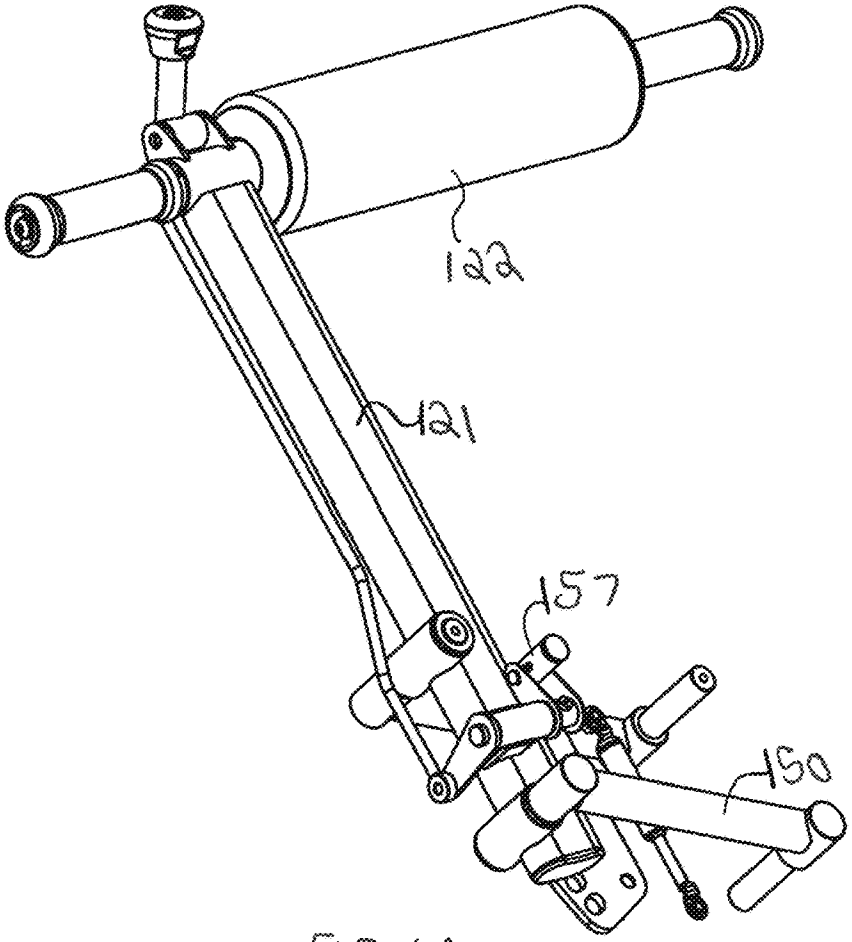

In an exemplary embodiment of positional adjuster 140 seen in FIGS. 15 to 16B, positional adjuster 140 comprises member 121 connected to back support 114 by a pair of parallel members 150 and 152. A pin (not shown) can be inserted through any of the apertures in selection aperture panel 155 to lock the position of arms 150 and 152. A travel limit pin 157 is free to move within the constraints of the side groove of selection aperture panel 155. (Specifically, as seen in FIG. 15, pin 157 is at the lowermost position when padded arm 122 is positioned against the user's abdomen. Conversely, as seen in FIGS. 16A and 16B, pin 157 is at the uppermost position when padded arm 122 is positioned farthest away from the user's abdomen.)

Figure 17:
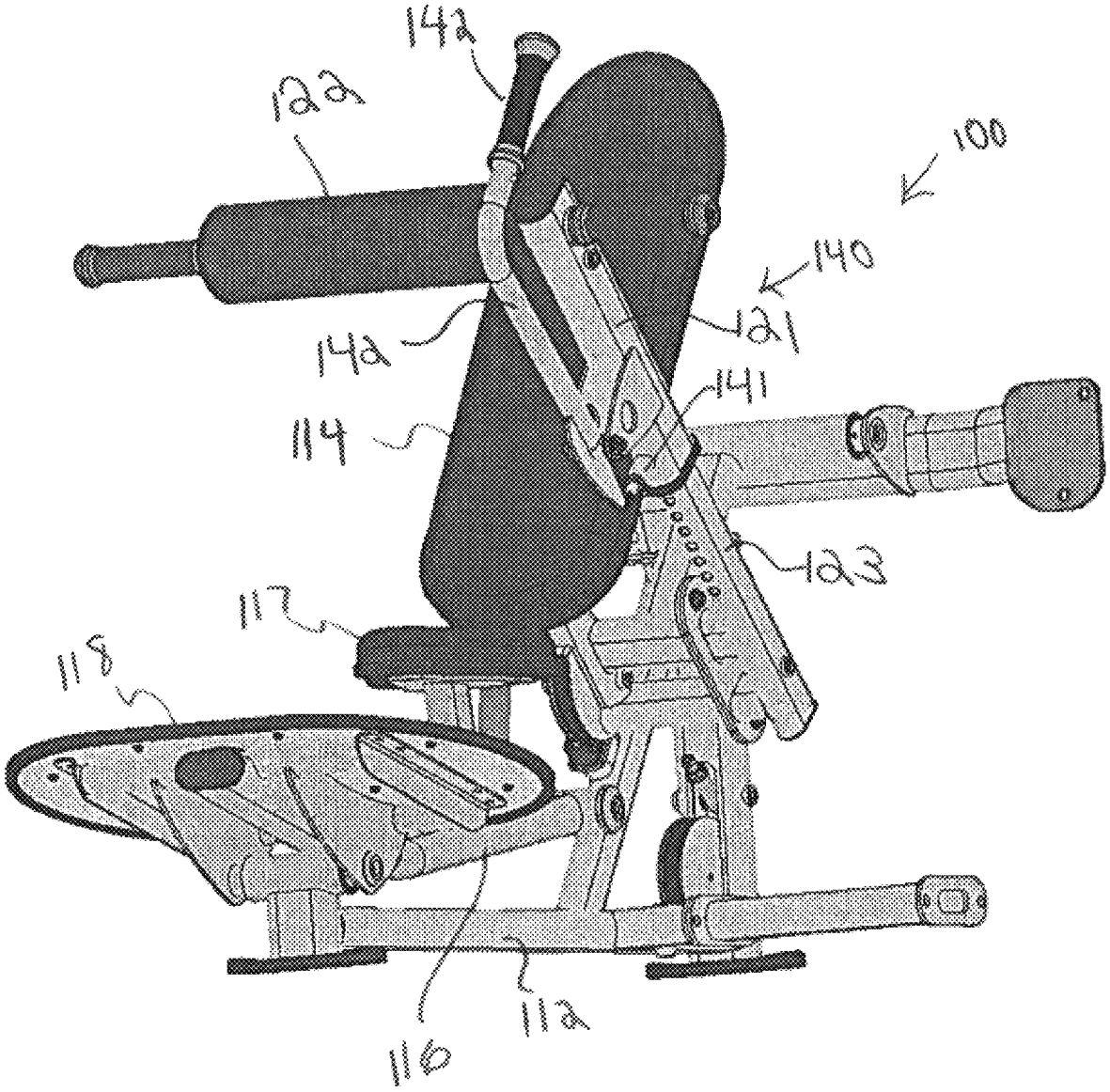
FIG. 17 is a front perspective view of an optional embodiment of the present system showing another mechanism for moving the abdomen restraint.

FIG. 17 shows another embodiment of positional adjuster 140 (in which moveable member 121 telescopes over stationary member 123). Specifically, adjuster 140 can be used to lock and unlock a pin 141 in the telescoping member 121 (which is received over stationary member 123). Adjuster 140 can comprise a rocker arm 142, as shown. The user simply pulls back on rocker arm 142 to unlock pin 141 (permitting telescoping member 121 to be moved with respect to stationary member 123). When the preferred position of padded arm 122 is reached, rocker arm 142 can then be pushed forward to lock pin 141 through the holes in members 121 and 123, thereby locking padded arm 122 across the user's abdomen.

Figure 18:
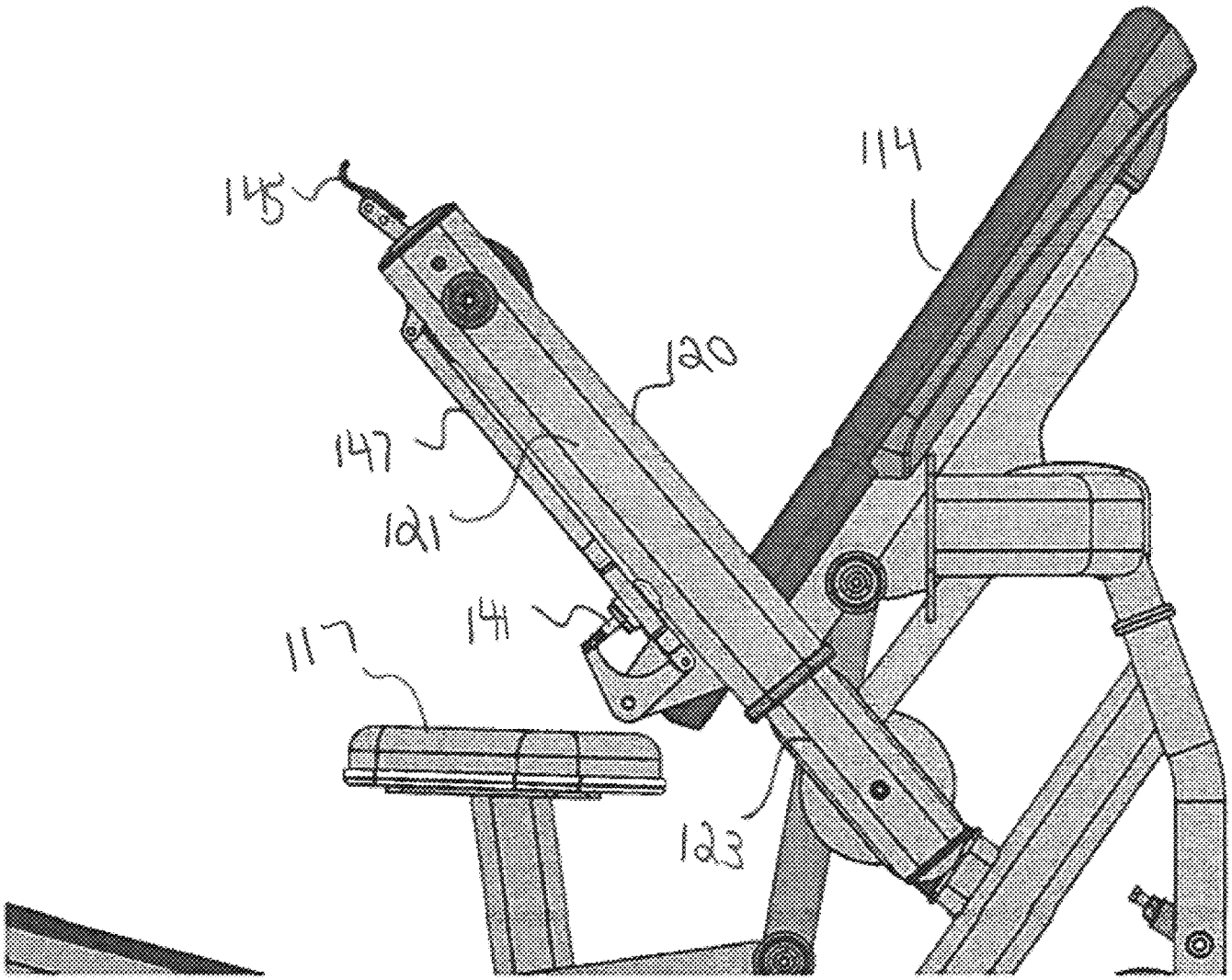
FIG. 18 is a side elevation close-up view of an optional embodiment of the present system showing yet another mechanism for moving the abdomen restraint.

In an alternate exemplary embodiment of the positional adjuster, as seen in FIG. 18, adjuster 140 comprises a latch 145 at the distal end of telescoping member 121. Latch 145 moves member 148 which in turn locks/unlocks pin 141, as shown.

Figure 19:
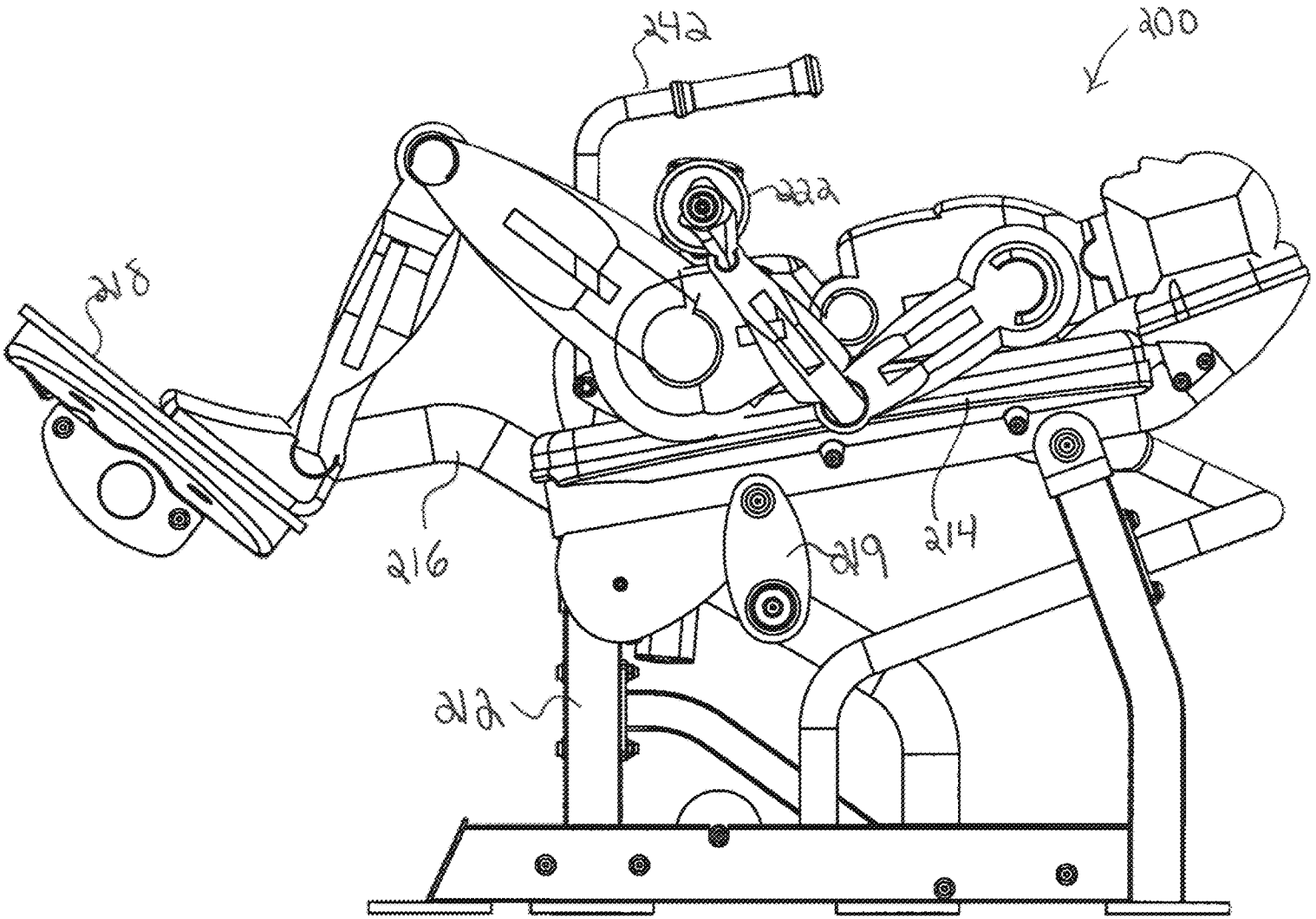
FIG. 19 is a side elevation view of a user sitting on a third embodiment of the present system, prior to performing a hip-thrust exercise.
Figure 20:
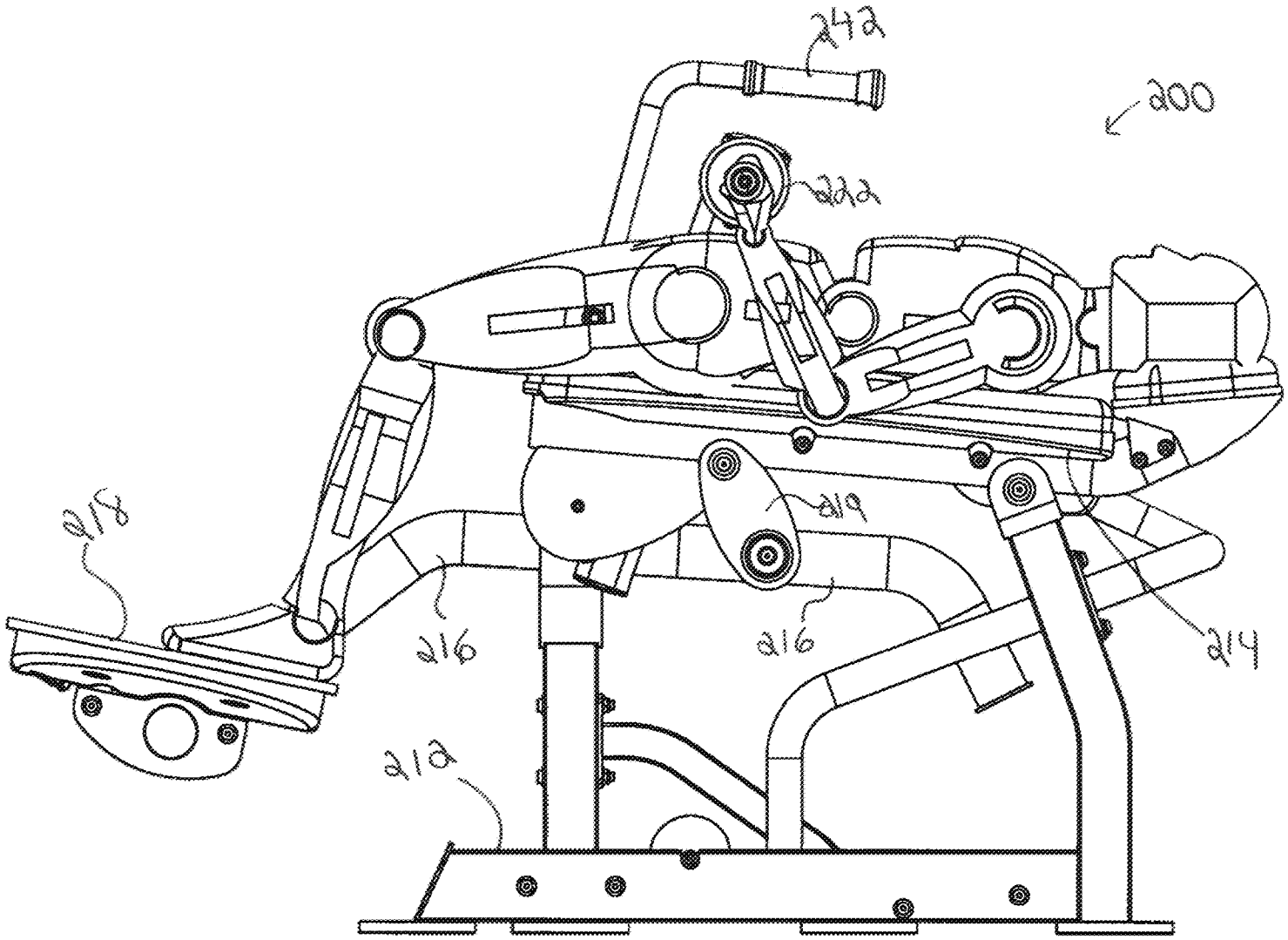
FIG. 20 is a is a side elevation view corresponding to FIG. 19, when the user is performing a hip-thrust exercise.
Figure 21:
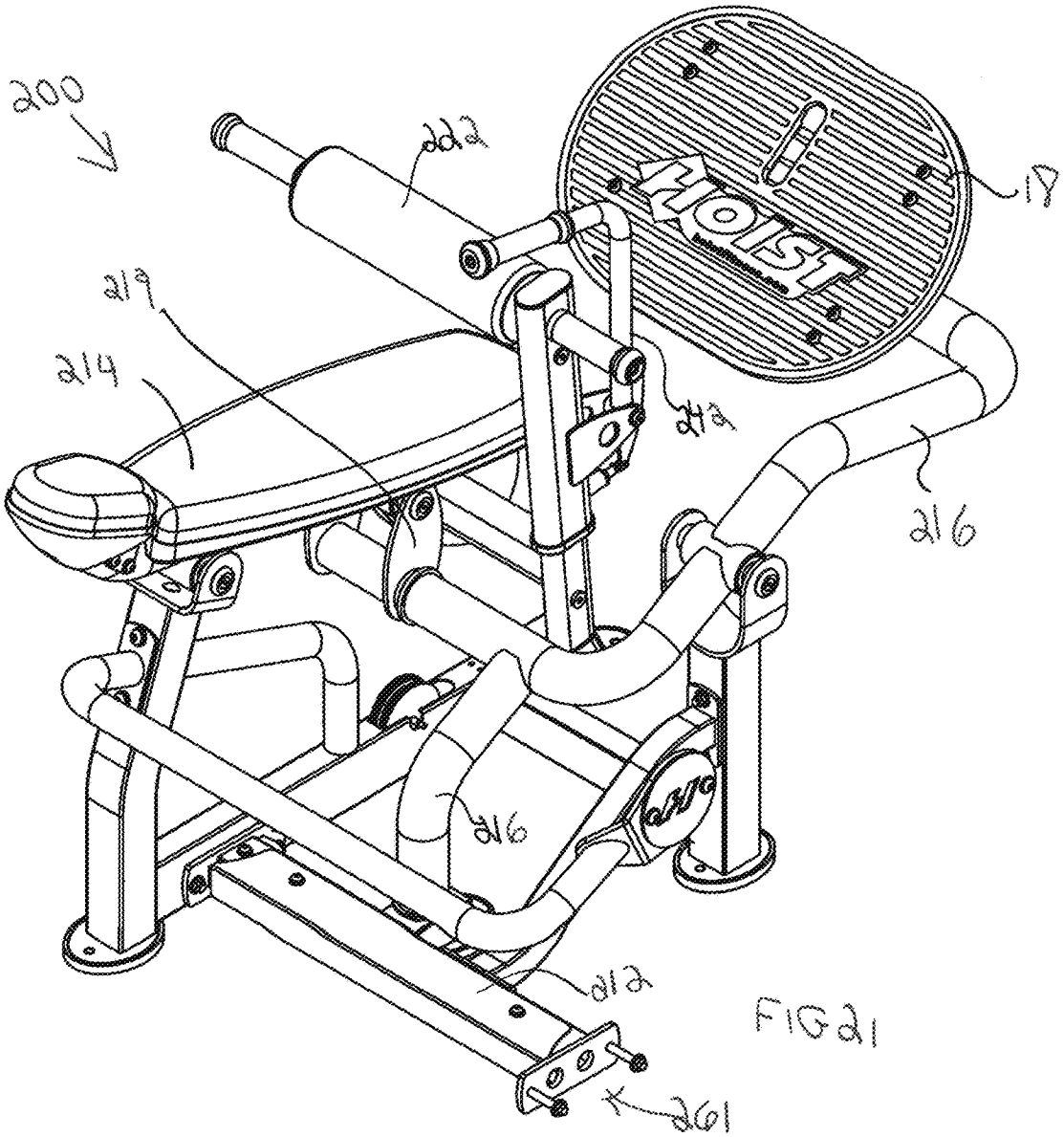
FIG. 21 is a rear perspective view of the machine shown in FIGS. 19 and 20.
Figure 2D:
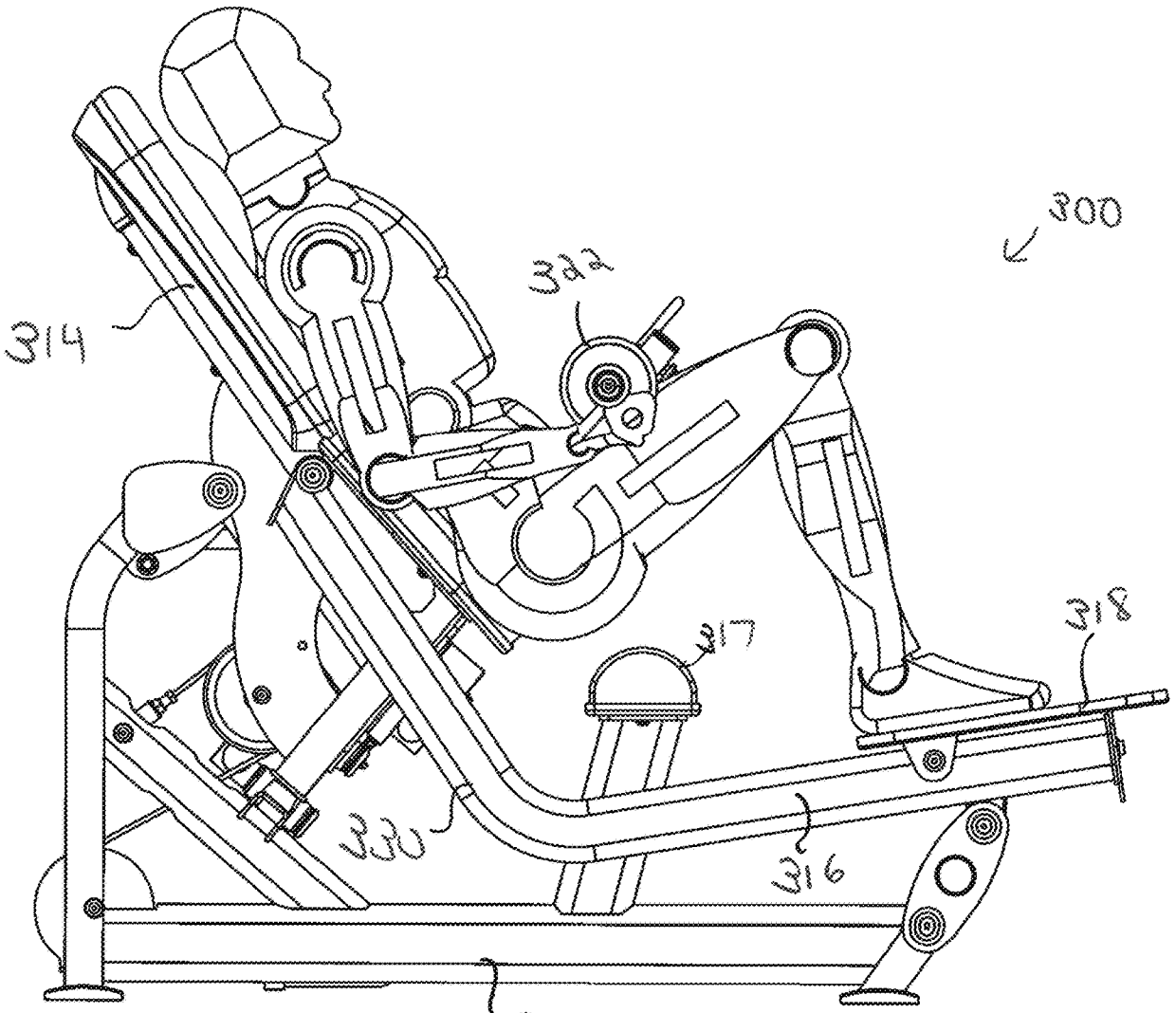

In yet another embodiment of the hip-thrust exercise machine 200 as seen in FIGS. 19 to 21, the user adopts a more reclining position prior to starting the hip-thrust exercise (FIG. 19). As can be seen, back support 214 supports the user's hips as well (and there is no need for a seat 117 as seen in FIG. 12). During the exercise, the user first moves padded arm 222 into a position against their abdomen. Next, the hip-thrust exercise is performed as shown in FIG. 20, with the user straightening their legs to simultaneously lift padded arm 222, tilt back support 214 backwards, and tilt foot pad 218 forwards (i.e.: push foot pad 218 downwardly) as the user thrusts their hips forward. In this particular embodiment, support 216 is not connected to a seat (e.g.: 117 in FIG. 12). Instead, support 216 is connected to a pivot member 219 which is connected to back support 214, as shown. FIG. 21 shows a rear perspective view of device 200.

Figure 23:
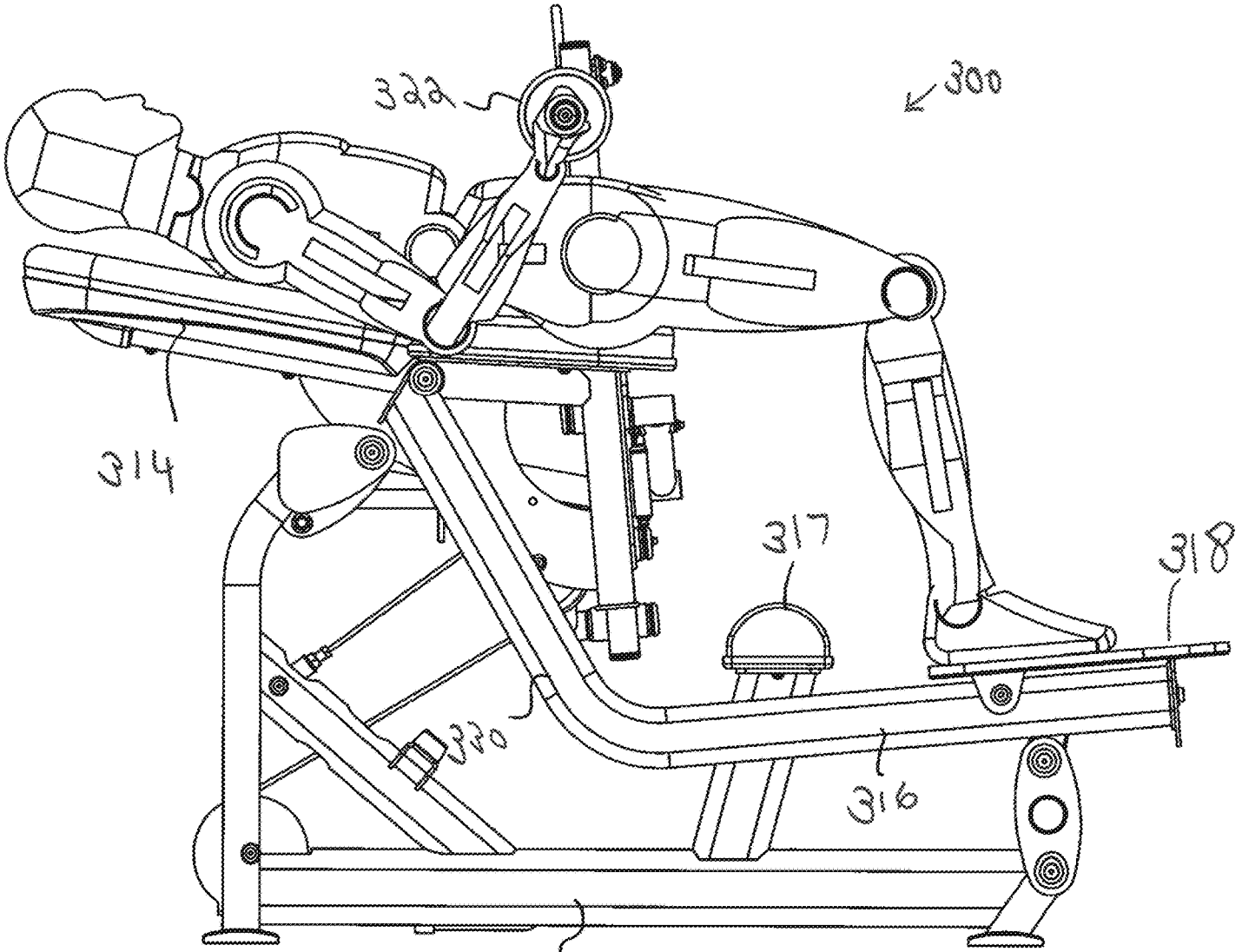
FIG. 23 is a side elevation view corresponding to FIG. 22, when the user is performing a hip-thrust exercise.
Figure 24B:
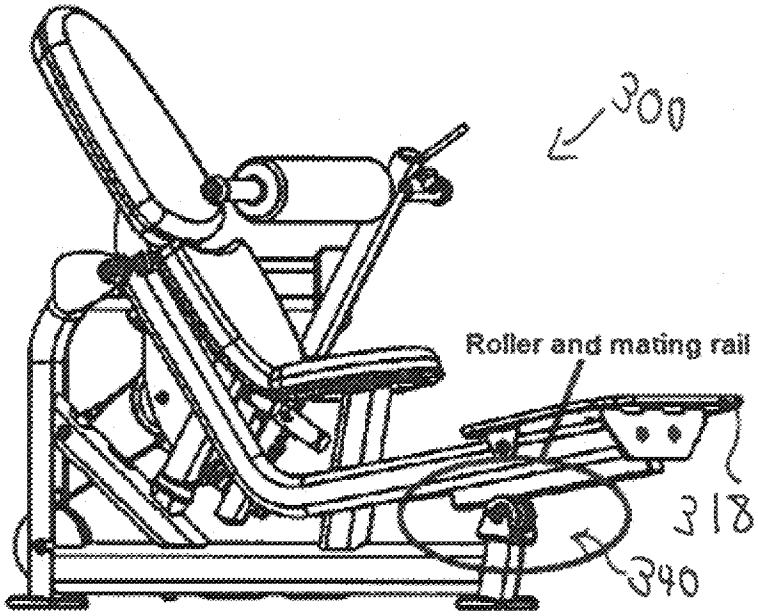
FIGS. 24A and 24B are two different embodiments of the present system showing two different optional mechanisms for allowing the user's lower leg to move back as the torso rocks back.
Figure 24A:
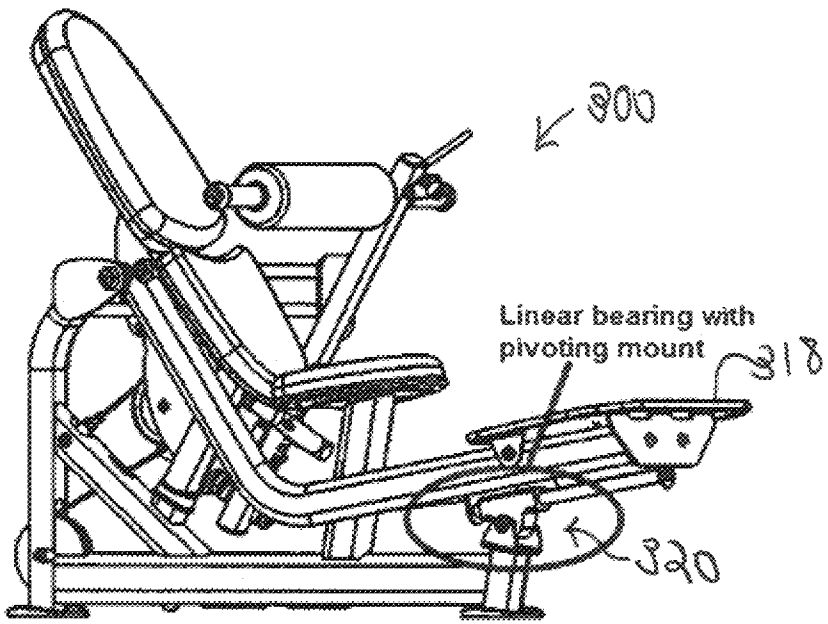

FIGS. 22 to 24B show yet another embodiment of device 300. In the device of FIGS. 22 and 23, the seat 317 remains stationary and does not move together with support 316. In addition, the hinge point directly under the foot has been replaced with a short link. Also, foot pad 318 is free to move back and forth slightly such that the user's lower leg moves back as the user's torso rocks back during the exercise. Lastly, as seen in FIGS. 24A and 24B, at least two different systems for moving foot mount 318 back and forth can be provided. Specifically, as seen in FIG. 24A, such systems can include a linear bearing with a pivot mount 320. Alternatively, as seen in FIG. 24B, such systems can include a roller and mating rail 340. Alternative systems may be used instead, all keeping within the scope of the present system. In addition, the footpad 318 can optionally slide with respect to support 316. In embodiments where the footpad 318 does not slide with respect to support 316, the footpad and system links act as a counter weight that automatically returns the machine to the starting point at the end of each exercise repetition. This is advantageous when light weights are selected as it eliminates the need for a discreet counterweight in the back pad assembly.

What is claimed is:

1. A glute press exercise machine, comprising:

a stationary frame;

a four-bar linkage connected to the stationary frame the four-bar linkage comprising a pair of forward bars and a pair of rearward bars;

a rotatable back support connected to top ends of each of the forward and rearward bars of the four-bar linkage;

a seat connected to at least one of the forward bars of the four-bar linkage;

a foot support connected to the stationary frame; and an abdomen restraint connected to the back support.

2. The exercise machine of claim 1, wherein the rotatable back support has an upper and a lower portion, and wherein the lower portion extends below the user's hips to support the users hips during a glute press exercise.

3. The exercise machine of claim 2, wherein the lower portion of the rotatable back support extends below the user's hips both before, during and after a glute press exercise.

4. The exercise machine of claim 2, wherein the lower portion of the rotatable back support supports at least 10% of the user's weight.

5. The exercise machine of claim 2, wherein the lower portion of the back support is angled under the user's hips to support the user's hips.

6. The exercise machine of claim 1, wherein the user's total body weight is not solely supported by the user's upper back and feet.

7. The exercise machine of claim 1, wherein the seat rotates downwardly away from the user's hips during a glute press exercise and rotates upwardly again to contact the user's bottom between exercise repetitions.

8. The exercise machine of claim 7, wherein the seat contacts the user's bottom between every repetition of glute press exercises.

9. The exercise machine of claim 1, wherein the bottom ends of the forward and rearward bars are connected to the stationary frame at locations near ground level.

10. The exercise machine of claim 1, wherein the forward and rearward bars each rotate between different non-vertical angles during a glute press exercise.

11. The exercise machine of claim 1, wherein the back support rotates about a horizontal axis that does not pass through the stationary frame.

12. The exercise machine of claim 1, wherein the foot support extends forwardly beyond the front of the stationary frame.

13. The exercise machine of claim 1, further comprising:

a weight stack assembly; and a cable connecting the rotatable back support to the weight stack assembly such that rotation of the rotatable back support lifts one or more weights in the weight stack assembly.

14. The exercise machine of claim 13, further comprising:

a stabilizing arm connecting the weight stack assembly to a rear portion of the stationary frame.

15. The exercise machine of claim 1, wherein the abdomen restraint is moveable in a direction generally perpendicular to the back support.

16. A glute press exercise machine, comprising:

a stationary frame;

a four-bar linkage connected to the stationary frame;

a rotatable back support connected to the four-bar linkage;

a seat connected to at least one of the bars of the four-bar linkage;

a foot support connected to the stationary frame; and an abdomen restraint connected to the back support, wherein the abdomen restraint is connected to the back support by a four-bar linkage.

17. A hip-thrust exercise machine, comprising:

a frame;

a back support connected to an upper portion of the frame;

a seat and foot support connected to a lower portion of the frame; and an abdomen restraint connected to the back support, wherein a user pushes the abdomen restraint upwards, tilts the back support backwards thereby lowering the seat away from the user and tilts the seat and foot support forwards when the user thrusts their hips forward.

18. The hip-thrust exercise machine of claim 17, wherein the seat and foot support moves together as a single unit.

19. A hip-thrust exercise machine, comprising:

a frame;

a back support connected to an upper portion of the frame;

a foot support connected to a lower portion of the frame;

an elongated member connecting the back support to the foot support; and an abdomen restraint connected to the back support, wherein a user pushes the abdomen restraint upwards, tilts the back support backwards and rotates the foot support when the user thrusts their hips forward.

20. The hip-thrust exercise machine of claim 19, wherein the foot support slides back and forth along the elongated member.

* * * * *